US006715461B2

(12) United States Patent
Ito et al.

(10) Patent No.: US 6,715,461 B2
(45) Date of Patent: Apr. 6, 2004

(54) SYSTEM FOR LUBRICATING VALVE-OPERATING MECHANISM IN ENGINE

(75) Inventors: Keita Ito, Wako (JP); Go Tanaka, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 37 days.

(21) Appl. No.: 10/216,655

(22) Filed: Aug. 12, 2002

(65) Prior Publication Data

US 2003/0051680 A1 Mar. 20, 2003

(30) Foreign Application Priority Data

Aug. 27, 2001 (JP) ..... 2001-256116
Nov. 19, 2001 (JP) ..... 2001-284677

(51) Int. Cl.[7] ..... F01M 09/10
(52) U.S. Cl. ..... 123/196 R; 123/196 M
(58) Field of Search ..... 123/196 R, 196 M, 123/196 S, 90.39, 90.48

(56) References Cited

U.S. PATENT DOCUMENTS

| | | | | |
|---|---|---|---|---|
| 4,501,234 A | * | 2/1985 | Toki et al. | 123/196 R |
| 5,887,564 A | * | 3/1999 | Kawamoto | 123/196 R |
| 6,422,194 B2 | * | 7/2002 | Ito et al. | 123/196 R |
| 6,510,829 B2 | * | 1/2003 | Ito et al. | 123/196 R |
| 6,591,819 B2 | * | 7/2003 | Tscherne et al. | 123/196 R |

FOREIGN PATENT DOCUMENTS

| | | |
|---|---|---|
| EP | 0 911 496 A | 4/1999 |
| EP | 1 134 365 A | 9/2001 |
| EP | 1 172 529 A | 1/2002 |
| EP | 1 201 887 A | 5/2002 |
| JP | 11-125107 | 5/1999 |

* cited by examiner

*Primary Examiner*—Henry C. Yuen
*Assistant Examiner*—Jason Benton
(74) *Attorney, Agent, or Firm*—Westerman, Hattori, Daniels & Adrian, LLP

(57) ABSTRACT

In a system for lubricating a valve-operating mechanism in an engine including a head cover coupled to an upper end of a cylinder head, and a valve-operating chamber defined between the cylinder head and the head cover. An oil mist transfer means for transferring an oil mist in an oil tank, an oil recovery chamber for recovering the oil accumulated in the valve-operating chamber by suction and a breather chamber into which a blow-by gas is introduced from the valve-operating chamber lead to the valve-operating chamber. In the lubricating system, a gas-liquid separating chamber for separating oil drops from the oil mist fed from the transfer means to guide the oil mist containing no oil drops to the valve-operating chamber is disposed between the transfer means 61 and the valve-operating chamber. Thus, the oil mist containing no oil drops can be supplied to the valve-operating chamber to lubricate the valve-operating mechanism without a resistance.

7 Claims, 26 Drawing Sheets

UPSIDE DOWN STATE

LAID-SIDEWAYS STATE

SYSTEM FOR LUBRICATING VALVE-OPERATING MECHANISM IN ENGINE

BACKGROUND OF THE INVENTION

1. Field of the Invention

The present invention relates to a hand-held type 4-cycle engine used as a power source mainly for a trimmer and other portable working machines, and particularly to an improvement in a system for lubricating a valve-operating mechanism in an engine including a head cover coupled to an upper end of a cylinder head, a valve-operating chamber defined between the cylinder head and the head cover for accommodation of a valve-operating mechanism, an oil mist transfer means for transferring an oil mist produced in an oil tank, an oil recovery chamber for recovering the oil accumulated in the valve-operating chamber by suction, a breather chamber into which a blow-by gas is introduced from the valve-operating chamber and from which the blow-by gas is discharged to the outside, the oil mist transfer means, the oil recovery chamber and the breather chamber leading to the valve-operating chamber, and an oil return passage connected to the oil recovery chamber for returning the oil recovered in the oil recovery chamber to the oil tank.

2. Description of the Related Art

A conventional valve-operating mechanism lubricating system in an engine is already known, for example, as disclosed in Japanese Patent Application Laid-open No. 11-125107.

In the conventional valve-operating mechanism lubricating system in the engine, the oil mist transfer means is connected directly to the valve-operating chamber, so that oil drops generated during transferring of the oil mist are also supplied to the valve-operating chamber and act as a resistance against the operation of the valve-operating mechanism, which is one factor of a power loss.

To enhance the gas-liquid separating function of the breather chamber, it is effective that the volume of the breather chamber is increased. However, to increase the volume of the breather chamber in a conventional breather device, it is necessary to increase the size of the head cover itself. This brings about an increase in size of the engine.

SUMMARY OF THE INVENTION

Accordingly, it is an object of the present invention to provide a system for lubricating a valve-operating mechanism in an engine, wherein the valve-operating mechanism can be lubricated without a resistance by supplying an oil mist containing no oil drops to a valve-operating chamber, and the gas-liquid separating function can be enhanced without an increase in size of a head cover.

To achieve the above object, according to a first feature of the present invention, there is provided a system for lubricating a valve-operating mechanism in an engine including a head cover coupled to an upper end of a cylinder head, a valve-operating chamber defined between the cylinder head and the head cover for accommodation of a valve-operating mechanism, an oil mist transfer means for transferring an oil mist produced in an oil tank, an oil recovery chamber for recovering the oil accumulated in the valve-operating chamber by suction, a breather chamber into which a blow-by gas is introduced from the valve-operating chamber and from which the blow-by gas is discharged to the outside, the oil mist transfer means, the oil recovery chamber and the breather chamber leading to the valve-operating chamber, and an oil return passage connected to the oil recovery chamber for returning the oil recovered in the oil recovery chamber to the oil tank, wherein a gas-liquid separating chamber is disposed in the valve-operating chamber below the breather chamber and incorporated in a path extending from the oil mist transfer means via the valve-operating chamber to the breather chamber for separating oil drops from the oil mist or the blow-by gas.

The valve-operating chamber and the oil mist transfer means correspond to a second valve-operating chamber 21*b* and a one-way valve 61 in each of embodiments of the present invention respectively, which will be described hereinafter.

With the first feature, the gas-liquid separating chamber can be disposed by effectively utilizing a relatively wide space in the valve-operating chamber below the breather chamber. When the gas-liquid separating chamber is provided in a path between the oil mist transfer means and the valve-operating chamber, the oil drops produced during transfer of the oil mist can be separated in the gas-liquid separating chamber, and the oil mist containing no oil drops can be supplied to the valve operating chamber. Therefore, the valve-operating mechanism can be lubricated without a resistance, and a decrease in power loss can be achieved. When the gas-liquid separating chamber is provided in a path between the valve-operating chamber and the breather chamber, the blow-by gas in the valve-operating chamber can be effectively subjected to the gas-liquid separation conducted by two stages of expansion in the gas-liquid separating chamber and the breather chamber, and the blow-by gas containing substantially no oil can be discharged to the outside. Therefore, the unnecessary consumption of the oil can be suppressed. Moreover, since the gas-liquid separating chamber is disposed in the valve-operating chamber below the breather chamber, the volume of the breather chamber within the head cover need not be increased, whereby an increase in size of the head cover can be avoided.

According to a second feature of the present invention, in addition to the first feature, a partitioning member is mounted to an inner wall of the head cover to define the breather chamber between the partitioning member and a ceiling surface of the head cover; the oil recovery chamber is formed integrally with the partitioning member; and the gas-liquid separating chamber is defined between the partitioning member and the cylinder head.

With the second feature, the oil recovery chamber and the breather chamber can be provided in the head cover without dividing a ceiling wall of the head cover. Moreover, both the breather chamber and the oil recovery chamber exist within the head cover and hence, even if the leakage of a small amount of the oil from both of the chambers occurs, the leaked oil is merely returned to the valve-operating chamber without any trouble. Thus, the examination of an oil-tightness around both the chambers is not required and hence, a reduction in manufacture cost can be provided. Moreover, the partitioning member is also utilized to define the gas-liquid separating chamber and hence, the structure can be simplified.

According to a third feature of the present invention, in addition to the first or second feature, the gas-liquid separating chamber is provided between the oil mist transfer means and the valve-operating chamber for separating oil drops from the oil mist fed from the oil mist transfer means to guide the oil mist containing no oil drops to the valve-operating chamber.

With the third feature, the oil drops produced during transfer of the oil mist are separated in the gas-liquid separating chamber, and the oil mist containing no oil drops can be supplied to the valve-operating chamber. Therefore, the valve-operating mechanism can be lubricated without a resistance, and a decrease in power loss can be achieved.

According to a fourth feature of the present invention, in addition to the third feature, the gas-liquid separating chamber is disposed between a pair of intake and exhaust rocker shafts of the valve-operating mechanism which are arranged in parallel to each other.

With the fourth feature, a relatively narrow space in the head cover can be also utilized efficiently to define the gas-liquid separating chamber, whereby an increase in size of the head can be avoided.

According to a fifth feature of the present invention, in addition to the third or fourth feature, the gas-liquid separating chamber communicates with an oil return passage to return the oil drops separated in the gas-liquid separating chamber to the oil tank.

With the fifth feature, the oil drops separated in the gas-liquid separating chamber can be immediately returned to the oil tank, whereby the entering of the oil drops into the valve-operating chamber can be inhibited.

According to a sixth feature of the present invention, in addition to the first or second feature, the gas-liquid separating chamber communicates with the valve-operating chamber and the breather chamber through first and second communication bores, respectively.

With the sixth feature, the blow-by gas in the valve-operating chamber can be subjected effectively to the gas-liquid separation conducted by two stages of expansion in the gas-liquid separating chamber and the breather chamber, and the blow-by gas containing substantially no oil can be discharged to the outside. Therefore, the unnecessary consumption of the oil can be suppressed. Moreover, since the gas-liquid separating chamber is disposed in the valve-operating chamber below the breather chamber, the volume of the breather chamber within the head cover need not be increased, whereby an increase in size of the head cover can be avoided.

According to a seventh feature of the present invention, in addition to the sixth feature, the gas-liquid separating chamber is disposed between components of the valve-operating mechanism.

The components of the valve-operating mechanism correspond to rocker shafts 31*i* and 31*e* in each of embodiments of the present invention which will be described hereinafter.

With the seventh feature, a dead space between the components of the valve-operating mechanism can be utilized effectively for disposition of the gas-liquid separating chamber.

The above and other objects, features and advantages of the invention will become apparent from the following description of the preferred embodiment taken in conjunction with the accompanying drawings.

BRIEF DESCRIPTION OF THE DRAWINGS

FIG. 1 is a perspective view showing one example of use of a hand-held type 4-cycle engine.

FIG. 2 is a vertical sectional side view of the 4-cycle engine.

FIG. 3 is a sectional view taken along a line 3—3 in FIG. 2.

FIG. 4 is a sectional view taken along a line 4—4 in FIG. 2.

FIG. 5 is an enlarged sectional view of an essential portion of FIG. 2.

FIG. 6 is an exploded view of an essential portion of FIG. 5.

FIG. 7 is a sectional view taken along a line 7—7 in FIG. 4.

FIG. 8 is a sectional view taken along a line 8—8 in FIG. 4.

FIG. 9 is a sectional view taken along a line 9—9 in FIG. 8.

FIG. 10 is a sectional view taken along a line 10—10 in FIG. 5.

FIG. 11 is a sectional view taken along a line 11—11 in FIG. 5.

FIG. 12 is a sectional view taken along a line 12—12 in FIG. 5;

FIG. 13 is a diagram showing a path for lubricating the engine.

FIG. 14 is a view similar to FIG. 4, but showing the engine in an upside-down state; and FIG. 15 is a view similar to FIG. 4, but showing the engine in a laid-sideways state.

FIG. 16 is a vertical sectional side view of a hand-held type 4-cycle engine.

FIG. 17 is a sectional view taken along a line 17—17 in FIG. 16.

FIG. 18 is a sectional view taken along a line 18—18 in FIG. 16.

FIG. 19 is an exploded sectional view of an essential portion of FIG. 16.

FIG. 20 is an exploded view of an essential portion of FIG. 17.

FIG. 21 is a sectional view taken along a line 21—21 in FIG. 19.

FIG. 22 is a sectional view taken along a line 22—22 in FIG. 18.

FIG. 23 is a view taken along a line 23—23 in FIG. 19.

FIG. 24 is a sectional view taken along a line 24—24 in FIG. 22.

FIG. 25 is a sectional view taken along a line 25—25 in FIG. 19.

FIG. 26 is a diagram showing a path for lubricating the engine.

DESCRIPTION OF THE PREFERRED EMBODIMENTS

A first embodiment of the present invention shown in FIGS. 1 to 15 will be first described.

Figure 1:
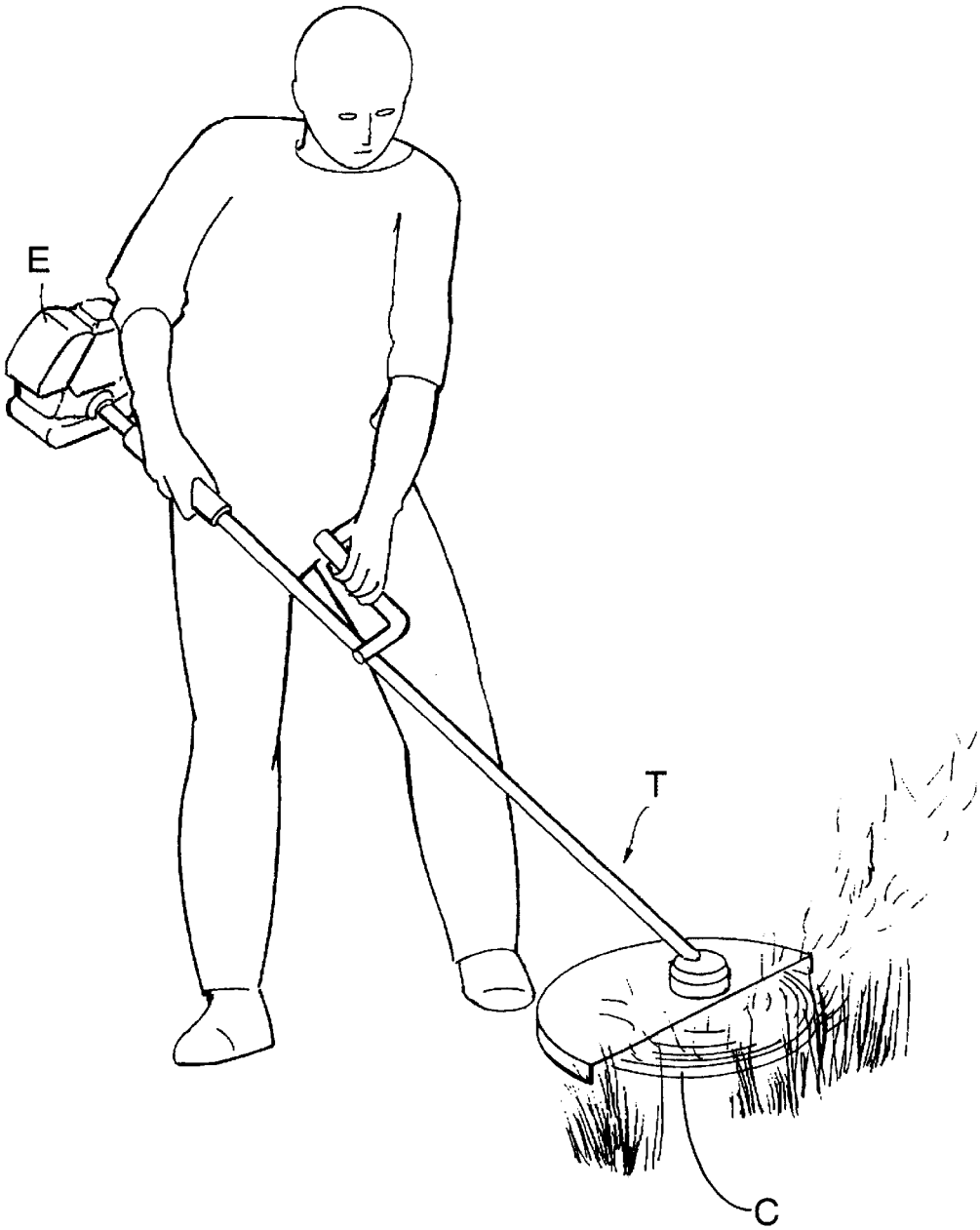
FIGS. 1 to 15 show a first embodiment of the present invention.

As shown in FIG. 1, a hand-held type 4-cycle engine E is mounted as a power source for a power trimmer T to a drive portion of the power trimmer T. The power trimmer T is used with its cutter C turned in various directions depending on the working state of the power trimmer T and in each case, the engine E is inclined to a large extent, or turned upside down. Therefore, the operational position of the engine E is not constant.

Figure 2:
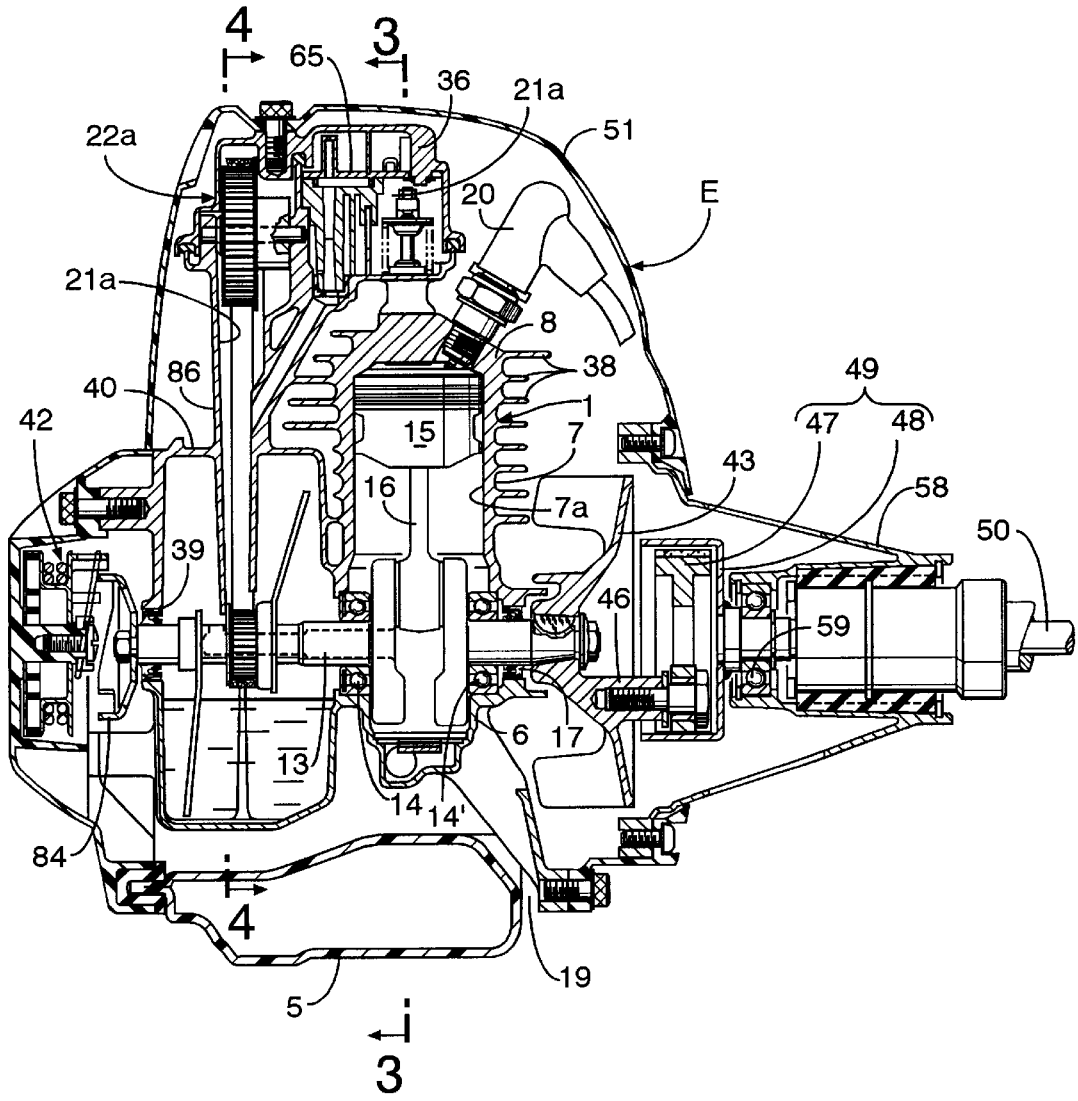
Figure 3:
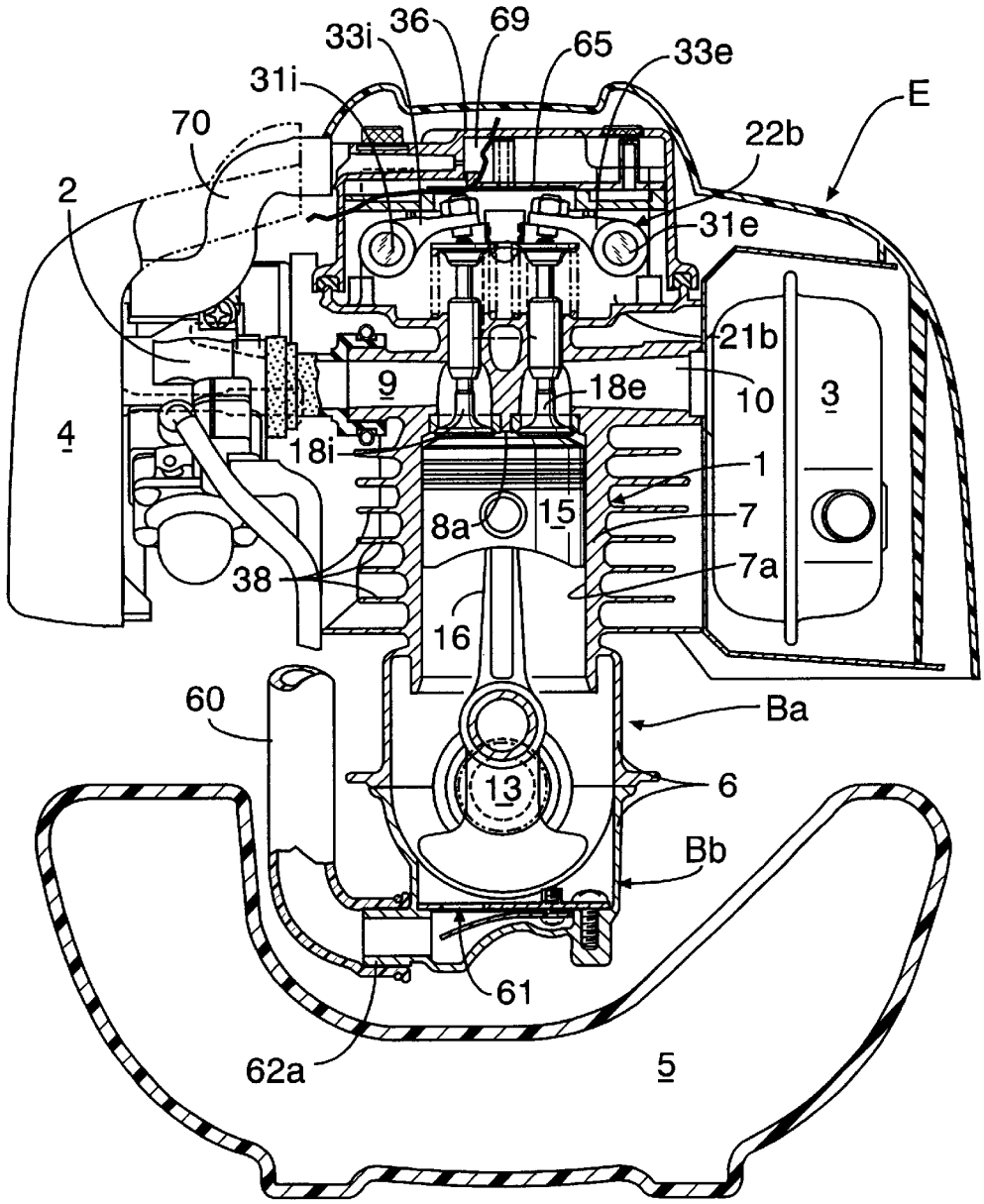

First of all, the structure around an exterior of the hand-held type 4-cycle engine E will be described with reference to FIGS. 2 and 3.

A carburetor 2 and an exhaust muffler 3 are mounted on front and rear portions of an engine body 1 of the hand-held type 4-cycle engine E, respectively. An air cleaner 4 is mounted in an inlet of an intake passage in the carburetor 2. A fuel tank 5 made of a synthetic resin is mounted to a lower surface of the engine body 1. Opposite ends of a crankshaft 13 protrude sideways out of the engine body 1 and an oil tank 40 adjoining one side of the engine body 1. A recoiled stator 42 is mounted to an outer side face of the oil tank 40 and capable of being operatively connected to a driven member 84 secured to one end of the crankshaft 13.

A cooling fan 43 also serving as a flywheel is secured to the other end of the crankshaft 13. A plurality of mounting bosses 46 (one of which is shown in FIG. 2) are formed on an outer surface of the cooling fan 43. A centrifugal shoe 47 is swingably supported on each of the mounting bosses 46. The centrifugal shoe 47 constitutes a centrifugal clutch 49 together with a clutch drum 48 secured to a drive shaft 50 which will be described hereinafter. When the rotational speed of the crankshaft 13 exceeds a predetermined value, the centrifugal shoe 47 is brought into pressure contact with an inner peripheral surface of the clutch drum 48 by a centrifugal force of the centrifugal shoe 47 itself, to transmit an output torque from the crankshaft 13 to the driveshaft 50. The cooling fan has a diameter larger than that of the centrifugal clutch 49.

An engine cover 51 for covering the fuel tank 5 and attachment components excluding the engine body 1, is secured in place to the engine body 1. A cooling-air intake port 19 is provided between the engine cover 51 and the fuel tank 5. Therefore, the external air is introduced through the cooling-air intake port 19 by the rotation of the cooling fan 43 and used to cool various portions of the engine E.

A frustoconical bearing holder 58 is secured to the engine cover 51 and arranged coaxially with the crankshaft 6. The bearing holder 58 supports the driven shaft 50 for rotating the cutter C with a bearing 59 interposed therebetween.

The oil tank 40 and the stator 42 are disposed on one side of the engine body 1, and the cooling fan 43 and the centrifugal clutch 49 are disposed on the other side of the engine body 1. Therefore, the weight balance between the left and right sides of the engine E is good, so that the center of gravity of the engine can be put closer to the center portion of the engine body 1, leading to an improved operability of the engine E.

In addition, since the cooling fan 43 having the diameter larger than that of the centrifugal shoe 47 is secured to the crankshaft 13 between the engine body 1 and the centrifugal shoe 47, an increase in size of the engine E due to the cooling fan 43 can be avoided to the utmost.

The structures of the engine body 1 and the oil tank 40 will be described below.

Referring to FIGS. 2 to 5, the engine body 1 comprises a crankcase 6 having a crank chamber 6*a*, a cylinder block 7 having a single cylinder bore 7*a*, and a cylinder head 8 having a combustion chamber 8*a* and intake and exhaust ports 9 and 10 which open into the combustion chamber 8*a*. A large number of cooling fins 38 are formed on outer peripheral surfaces of the cylinder block 7 and the cylinder head 8.

The crankshaft 14 accommodated in the crank chamber 6*a* is rotatably supported on laterally opposite sidewalls of the crankcase 6 with ball bearings 14 and 14' interposed therebetween. The left ball bearing 14 is provided with a seal, and an oil seal 17 is disposed adjacent the outsides of the right ball bearing 14'. A piston 15 received in the cylinder bore 7*a* is connected to the crankshaft 13 through a connecting rod 16, as conventionally usual.

The oil tank 40 is integrally connected to the left sidewall of the crankcase 6 to adjoin the outside of the crankcase 6. The crankshaft 13 is disposed so that its end on the side of the ball bearing 14 is provided with the seal and passed through the oil tank 40. An oil seal 39 is mounted on an outer sidewall of the oil tank 40 through which the crankshaft 13 is passed.

A belt guide tube 86 flat in section is integrally connected to a ceiling wall of the oil tank 40. The belt guide tube 86 extends vertically to pass through the ceiling wall and opens at its upper and lower ends. The lower end of the belt guide tube 86 extends to the vicinity of the crankshaft 13 within the oil tank 40, and the upper end of the belt guide tube 86 is integrally connected to the cylinder head 8 so that it shares a partition wall 85 with the cylinder head 8. A series of annular seal beads 87 are formed at upper peripheral edges of the cylinder head 8 and the upper end of the belt guide tube 86. The partition wall 85 protrudes upwards from the seal beads 87.

On the other hand, as shown in FIGS. 6 and 10 to 12, an annular seal groove 88*a* is defined in a lower end face of the head cover 36 to correspond to the seal beads 87. A linear seal groove 88*b* is defined in an inner surface of the head cover 36 to provide communication between opposite sides of the annular seal groove 88*a*. An annular packing 89*a* is mounted in the annular seal groove 88*a*, and a linear packing 89*b* formed integrally with the annular packing 89*a* is mounted in the linear seal groove 88*b*. The head cover 36 is coupled to the cylinder head 8 by a bolt 37 so that the seal beads 87 are brought into pressure contact with the annular packing 89*a*, and the partition wall 85 is brought into pressure contact with the linear packing 89*b*.

A first valve-operating chamber 21*a* is defined by the belt guide tube 86 and one of halves of the head cover 36. A second valve-operating chamber 21*b* is defined by the cylinder head 8 and the other half of the head cover 36. The valve-operating chambers 21*a* and 21*b* are partitioned from each other by the partition wall 85.

Referring again to FIGS. 2 to 5, the engine body 1 and the oil tank 40 are divided into an upper block Ba and a lower block Bb by a plane which extends through an axis of the crankshaft 13 and which is perpendicular to an axis of the cylinder bore 7*a*. More specifically, the upper block Ba is constituted by an upper half of the crankcase 6, the cylinder block 7, the cylinder head 8, an upper half of the oil tank 40 and the belt guide tube 86 which are integrally superposed together. The lower block Bb is constituted by a lower half of the crankcase 6 and a lower half of the oil tank 40 which are integrally superposed together. The upper and lower blocks Ba and Bb are formed individually by casting, and coupled to each other by a plurality of bolts 12 (see FIG. 4) after the portions thereof are finished.

An intake valve 18*i* and an exhaust valve 18*e* for opening and closing an intake port 9 and an exhaust port 10 respectively are mounted in parallel to each other in the cylinder head 8. A spark plug 20 is also threadedly mounted in the cylinder head 8 with its electrode set close to the center portion of the combustion chamber 8*a*.

A valve-operating mechanism 22 for opening and closing the intake valve 18*i* and the exhaust valve 18*e* will be described below with reference to FIGS. 3 to 7.

The valve-operating mechanism 22 comprises a timing transmitting device 22*a* disposed to extend from the inside of the oil tank 40 into the first valve-operating chamber 21*a*, and a cam device 22*b* disposed to extend from the first valve-operating chamber 21*a* into the second valve-operating chamber 21*b*.

The timing transmitting device 22*a* comprises a driving pulley 23 fixedly mounted on the crankshaft 13 within the oil tank 40, a driven pulley 24 rotatably supported at an upper portion of the belt guide tube 86, and a timing belt 25 reeved between the driving and driven pulleys 23 and 24. A cam 26 forming a portion of the cam device 22*b* is integrally coupled to an end face of the driven pulley 24 on the side of the partition wall 85. The driving and driven pulleys are toothed, and the driving pulley 23 is adapted to drive the driven pulley 24 at a reduction ratio of 1/2 through the belt 25.

A support wall 27 is integrally formed on an outer sidewall of the belt guide tube 86 so that it rises inside the annular seal beads 87 to abut against the inner surface of the head cover 36 or to extend to closer to such inner surface. A support shaft 29 is rotatably supported at its opposite ends by a through-bore 28*a* provided in the support wall 27 and a bottomed bore 28*b* provided in the partition wall 85. The driven pulley 24 and the cam 26 are rotatably supported on an intermediate portion of the support shaft 29. Before the head cover 36 is mounted, the support shaft 29 is inserted from the through-bore 28*a*, through a shaft bore 35 in the driven pulley 24, into the cam 26 and the bottomed bore 28*b*. When the head cover 36 is coupled to the cylinder head 8 and the belt guide tube 86 after the insertion of the support shaft 29, the inner surface of the head cover 36 is opposed to an outer end of the support shaft 29 to prevent the slipping-out of the support shaft 29.

Each of a pair of bearing bosses 30*i* and 30*e* rising up from the cylinder head 8 toward the second valve-operating chamber 21*b* and extending in parallel to the support shaft 29 is integrally coupled at one end to the partition wall 85. An intake rocker shaft 31*i* and an exhaust rocker shaft 31*e* of the cam device 22*b* are rotatably supported by the bearing bosses 30*i* and 30*e*. More specifically, the cam device 22*b* comprises the cam 26, the intake rocker shaft 31*i* and the exhaust rocker shaft 31*e*, an intake cam follower 22*i* and an exhaust cam follower 22*e* each secured to one end of each of the rocker shafts 31*i* and 31*e* in the first valve-operating chamber 21*a* with their tip ends in slidable contact with a lower surface of the cam 26, an intake rocker arm 33*i* and an exhaust rocker arm 33*e* secured to the other ends of the rocker shafts 31*i* and 31*e* in the second valve-operating chamber 21*b* with their tip ends abutting against upper ends of the intake valve 18*i* and the exhaust valve 18*e*, and an intake spring 34*i* and an exhaust spring 34*e* mounted on the intake valve 18*i* and the exhaust valve 18*e* for biasing these valve 18*i* and 18*e* in closing directions.

When the driving pulley 23 rotated along with the crankshaft 13 rotates the driven pulley 24 and the cam 26 through the belt 25, the cam 26 swings the intake and exhaust followers 32*i* and 32*e* properly, and the swinging movements of the intake and exhaust followers 32*i* and 32*e* are transmitted through the corresponding rocker shafts 31*i* and 31*e* to the intake and exhaust rocker arm 33*i* and 33*e* to swing the arms. Therefore, the intake and exhaust valves 18*i* and 18*e* can be opened and closed properly by cooperation with the intake and exhaust springs 34*i* and 34*e*.

In the timing transmitting device 22*a*, the driven pulley 24 and the cam 26 are rotatably supported on the support shaft 29, and the support shaft 29 is also rotatably supported on the opposite sidewalls of the first valve-operating chamber 21*a*. Therefore, during rotations of the driven pulley 24 and the cam 26, the support shaft 29 is also rotated, dragged by the friction and hence, the difference in rotational speed between the driven pulley 24 as well as the cam 26 and the support shaft 29 is decreased. Thus, it is possible to provide a reduction in friction between rotating and sliding portions, to contribute to an enhancement in durability.

A lubricating system for the engine E will be described below with reference to FIGS. 4 to 14.

Figure 4:
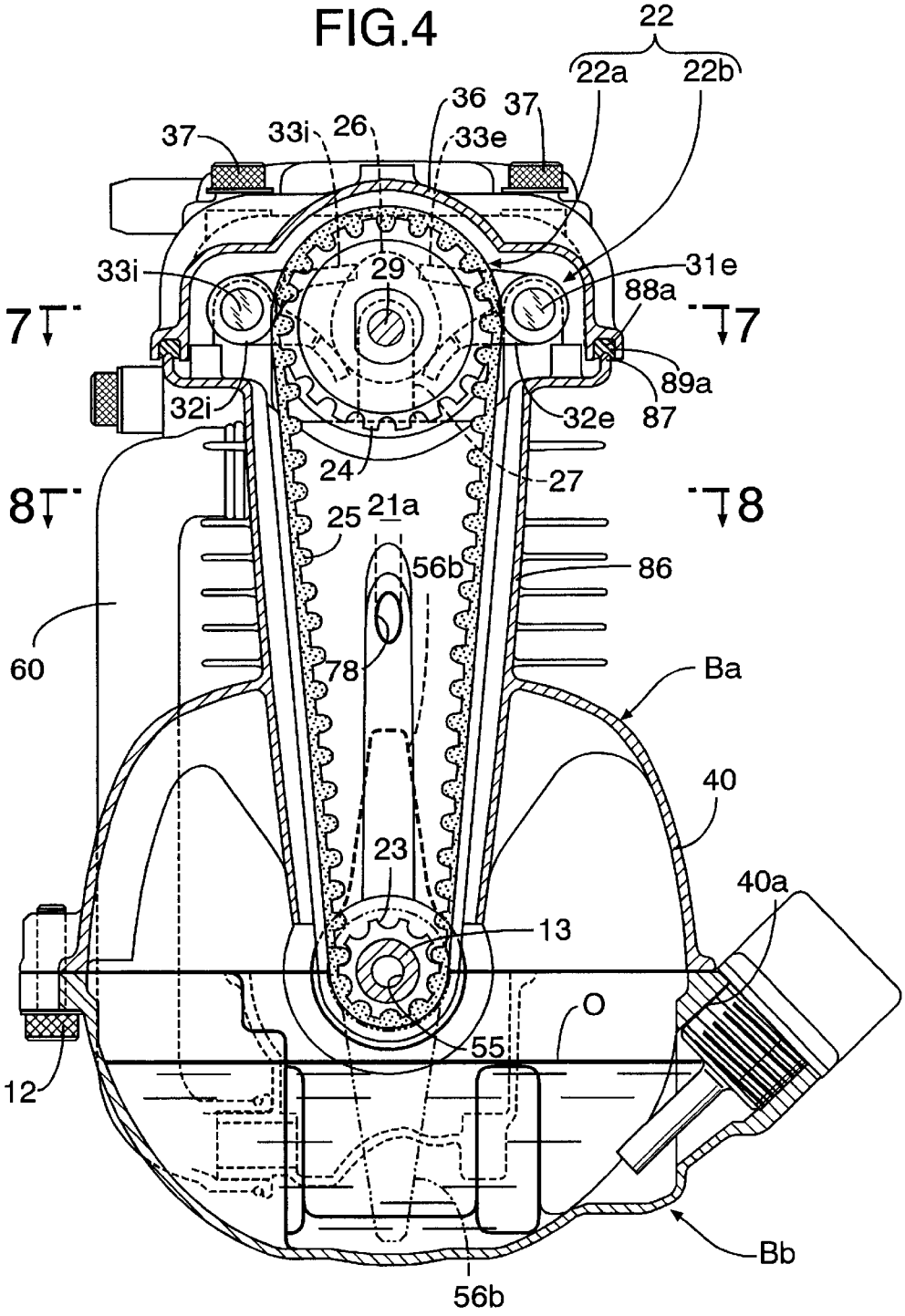
Figure 5:
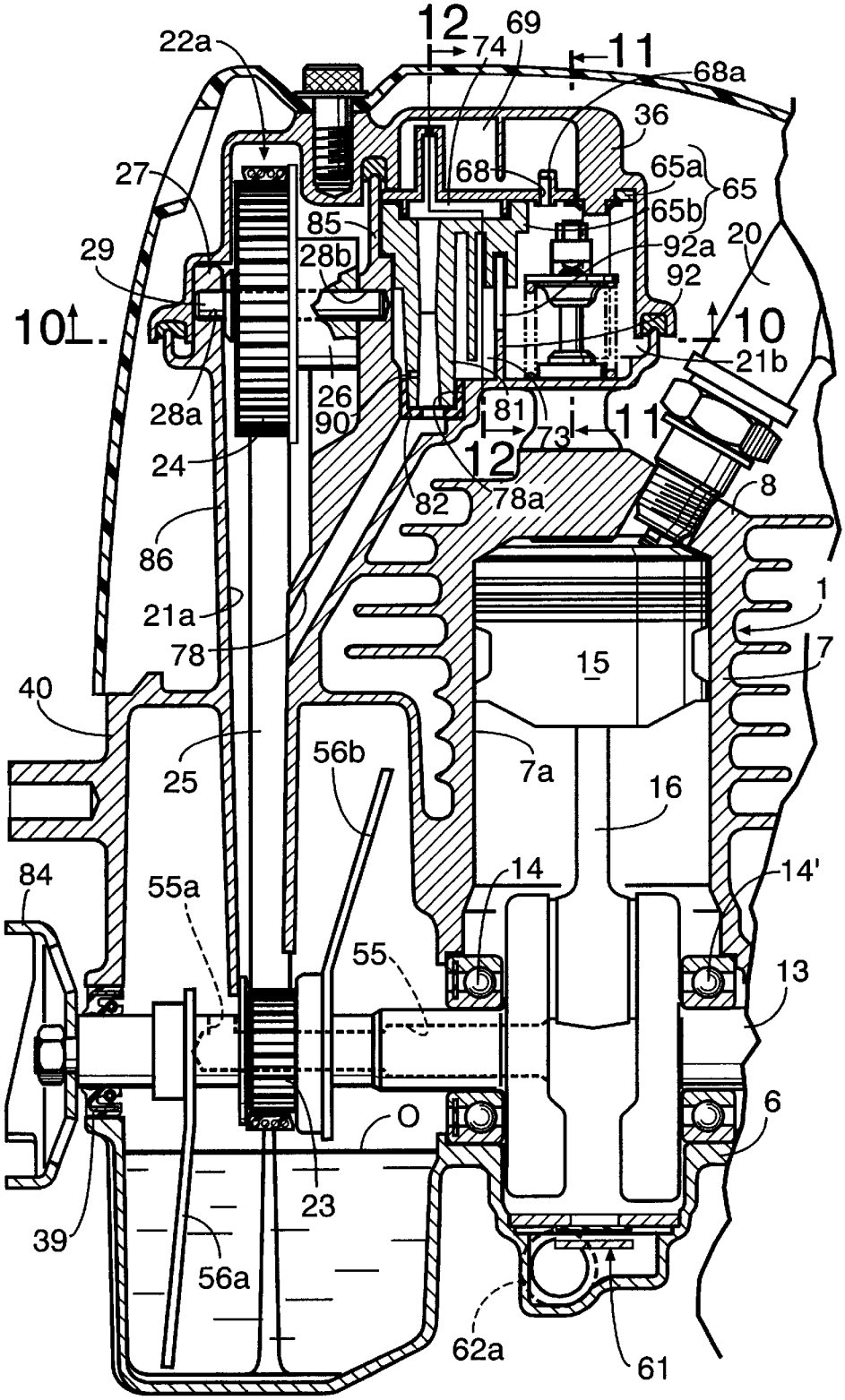
Figure 6:
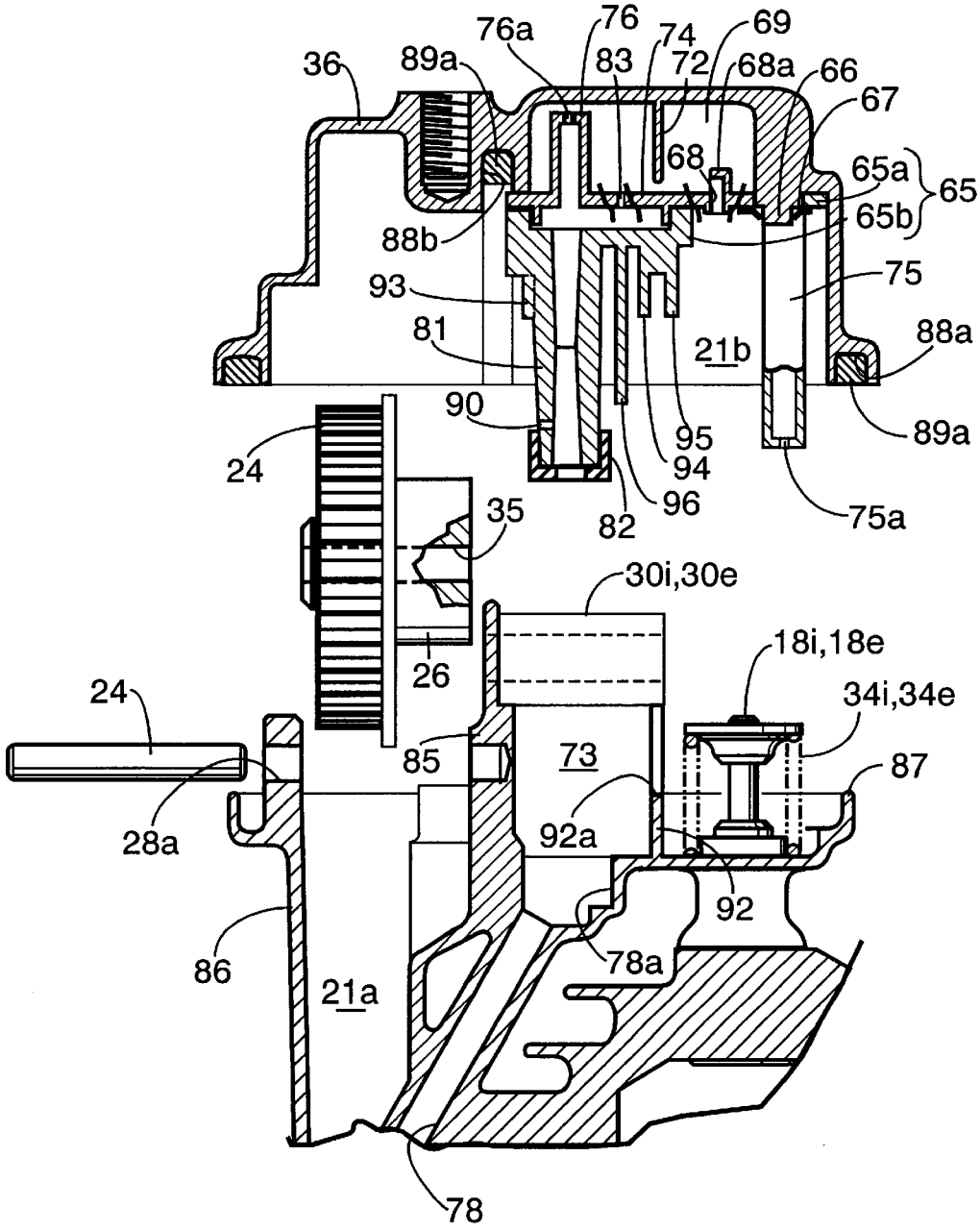
Figure 7:
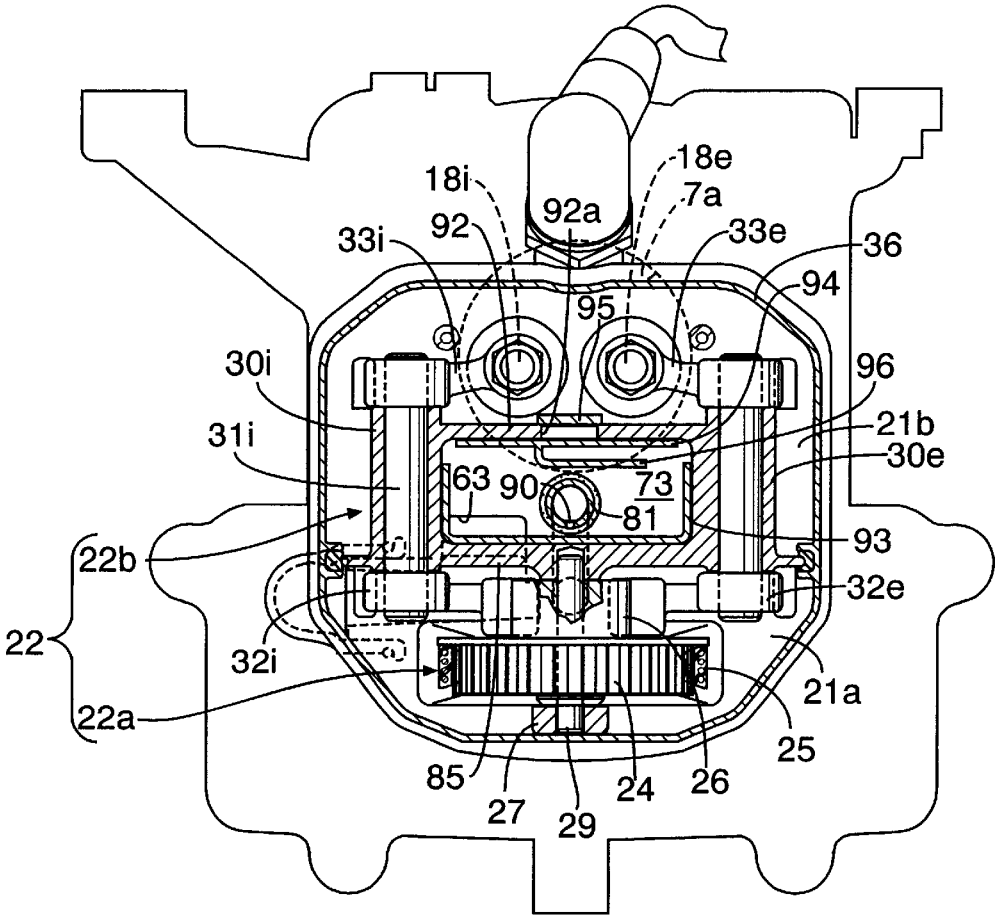
Figure 8:
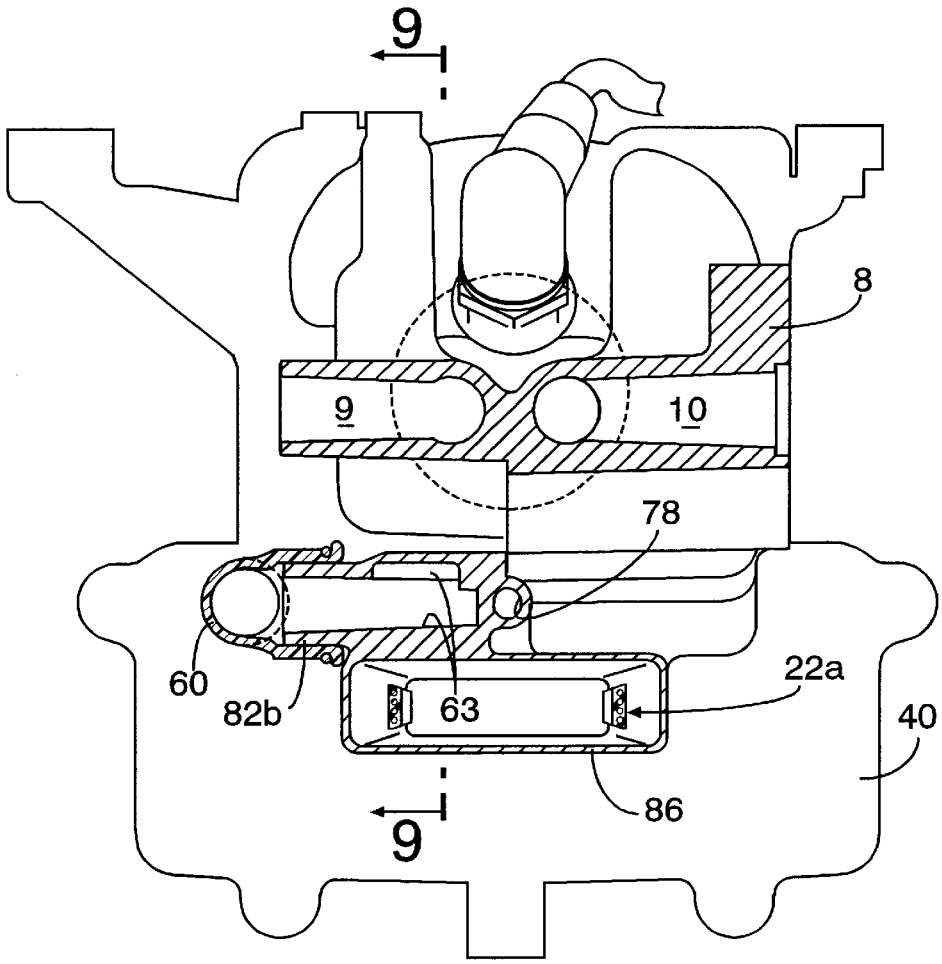
Figure 9:
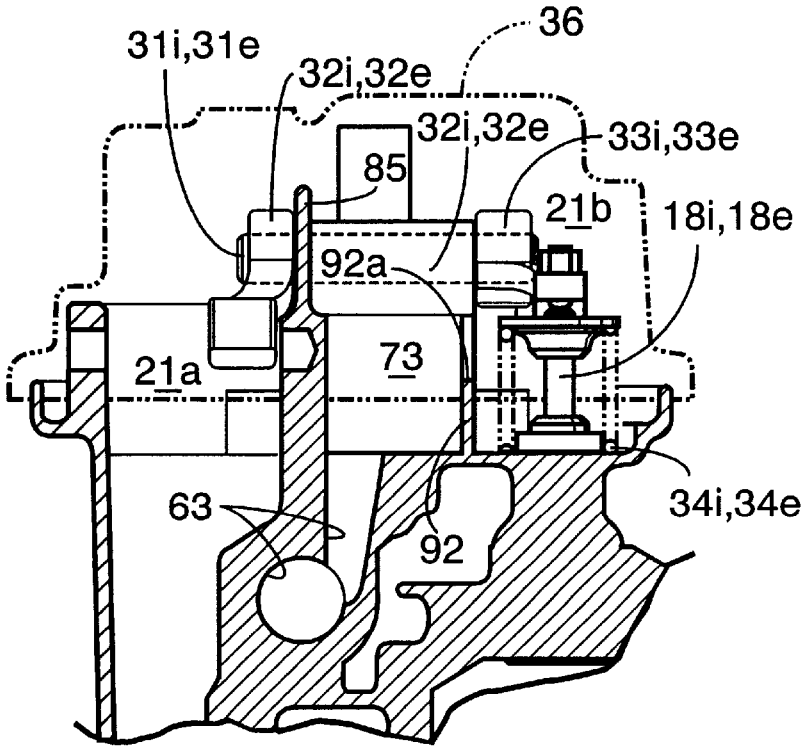
Figure 10:
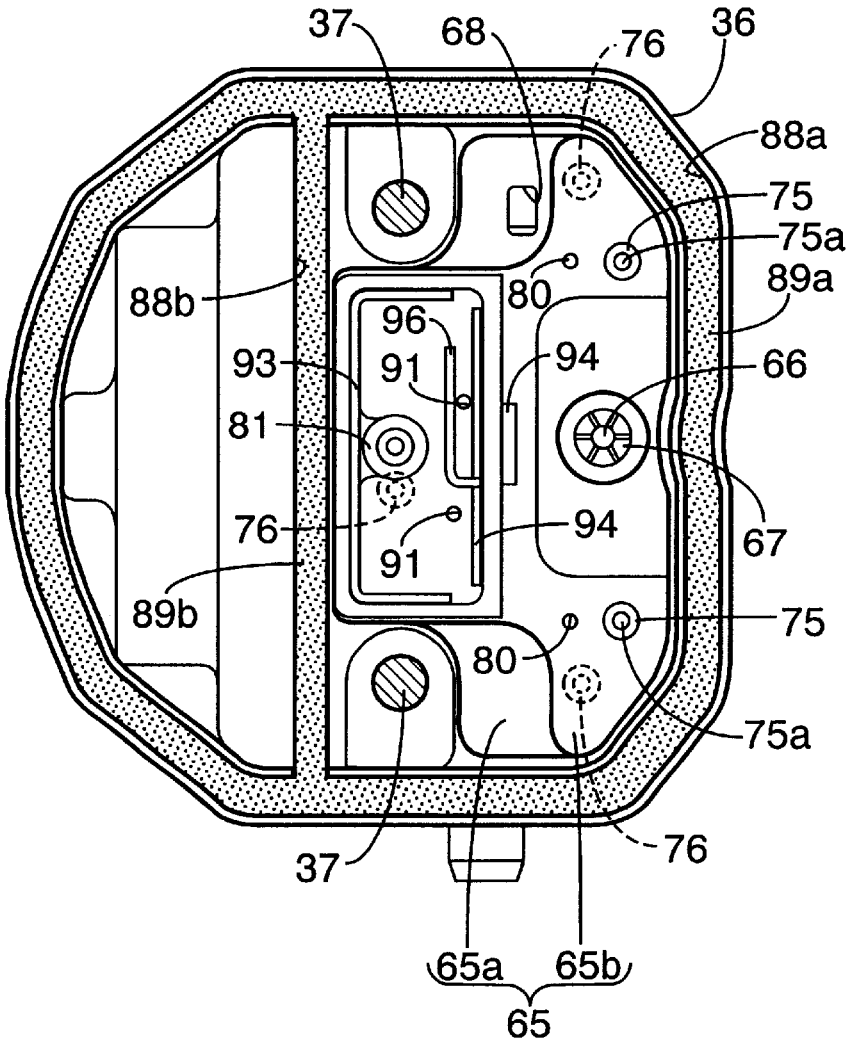
Figures 2, 11:
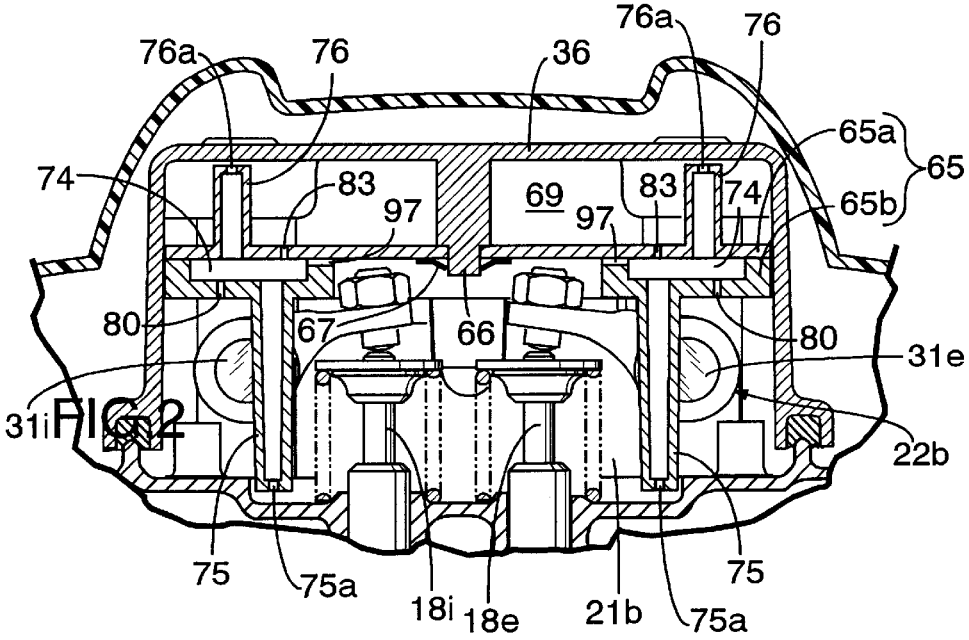
Figure 12:
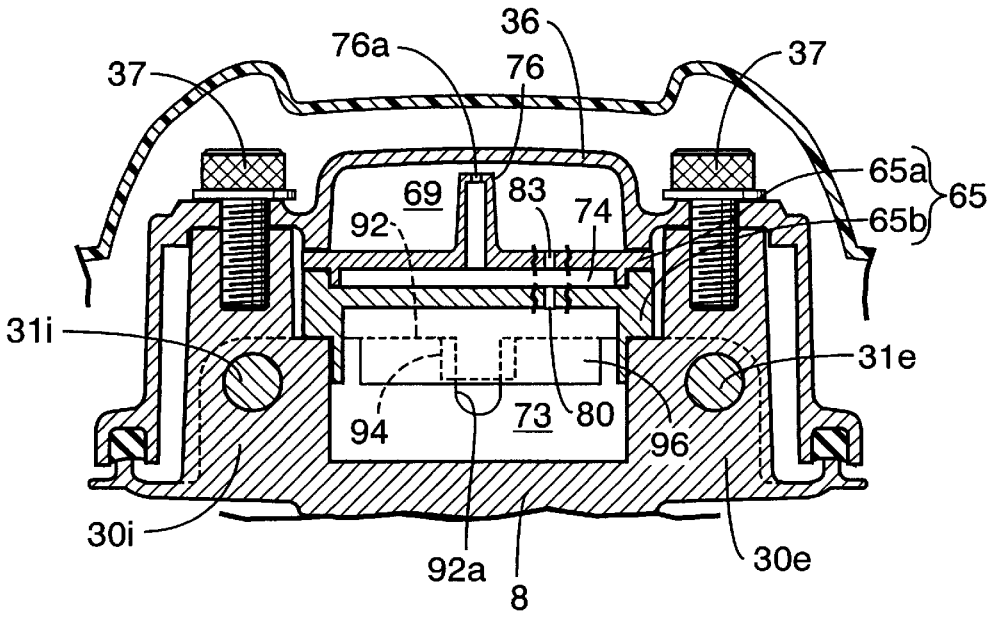

Referring to FIGS. 4 and 5, a specified amount of a lubricating oil O injected through an oil supply port 40*a* is stored in the oil tank 40. A pair of oil slingers 56*a* and 56*b* are secured by press-fitting or the like to the crankshaft 13 in the oil tank 40 and arranged axially on opposite sides of the driving pulley 23. The oil slingers 56*a* and 56*b* extend to radially opposite directions, and are bent so that their tip ends axially going away from each other. When the oil slingers 56*a* and 56*b* are rotated by the crankshaft 13, at least one of the oil slingers 56*a* and 56*b* agitates and scatters the oil O stored in the oil tank 40 even in any operative position of the engine E to produce an oil mist. At this time, the produced oil splash is sprinkled over a portion of the timing transmitting device 22*a* exposed from the first valve-operating chamber 21*a* to the inside of the oil tank 40, or caused to enter the first valve-operating chamber 21*a*, to thereby directly lubricate the timing transmitting device 22*a*. This is one line of the lubricating system.

As shown in FIGS. 3 and 5 to 13, the other line of the lubricating system includes a through-bore 55 provided in the crankshaft 13 to provide communication between the inside of the oil tank 40 and the crank chamber 6*a*, an oil feed conduit 60 connected to a lower portion of the crank chamber 6*a*, a gas-liquid separating chamber 73 for separating oil drops from the oil mist fed through the oil feed conduit 60 to guide the oil mist containing no oil drops to the second valve-operating chamber 21*b*, an oil recovery chamber 74 provided in the cylinder head 8 to draw up the oil drops accumulated in the second valve-operating chamber 21*b*, an oil return passage 78 defined between the cylinder head 8 and the oil tank 40 to permit the oil recovery chamber 74 to communicate with the oil tank 40 through the first valve-operating chamber 21*a*, and a one-way valve 61 placed at a lower portion of the crank chamber 6*a* to only permit the flow of the oil mist only in one direction from the crank chamber 6*a* to the oil feed conduit 60.

An end 55*a* of the through-bore 55 opened into the oil tank 40 is disposed at or in the vicinity of the center portion of the inside of the oil tank 40 so that it is always exposed above the surface of the oil O in the oil tank 40 even in any position of the engine E. The driving pulley 23 secured to the crankshaft 13 and one of the oil slingers 56*a* are disposed with the opened end 55*a* located therebetween so that they do not block the opened end 55*a*.

The one-way valve 61 (see FIG. 3) is a reed valve in the illustrated embodiment, and is operated with the reciprocal movement of the piston 15 so that it is closed when the inside of the crank chamber 6*a* is subjected to a negative pressure, and it is opened when the inside of the crank chamber 6*a* is subjected to a positive pressure.

The oil feed conduit 60 has a lower end fitted over and connected to a lower connecting pipe 62*a* (see FIG. 3) projectingly provided on the outer surface of the crankcase 6, and an upper end fitted over and connected to an upper connecting pipe 62*b* (see FIGS. 4 and 8) projectingly provided on the outer surface of the cylinder head 8. The inside of the upper connecting pipe 62*b* communicates with the gas-liquid separating chamber 73 through a communication passage 63 (see FIGS. 8 and 9) in the cylinder head 8.

The gas-liquid separating chamber 73 is defined by the bearing bosses 30*i* and 30*e* and a smaller partition wall 92 integrally formed on the cylinder head 8 to be opposed to the partition wall 85 and to connect the bearing bosses 30*i* and 30*e* to each other. The communication bore 63 opens into one corner of the gas-liquid separating chamber 73, and a notch-shaped outlet 92*a* is provided in the smaller partition wall 92 to permit the gas-liquid separating chamber 73 to communicate with the second valve-operating chamber 21*b*.

As shown in FIGS. 5 and 10 to 12, a partitioning member 65 is disposed on the head cover 36. The partitioning member 65 is comprised of an upper partition plate 65*a* made of a synthetic resin and defining a breather chamber 69 between the partition plate 65*a* and a ceiling surface of the head cover 36, and a lower partition plate 65*b* made of a synthetic resin and bonded to a lower surface of the upper partition plate 65*a* by welding or adhesion to define the flat oil recovery chamber 74 between the lower partition plate 65*b* and the upper partition plate 65*a*. To mount the partitioning member 65 to the head cover 36, a peripheral edge of the upper partition plate 65*a* is put into abutment against a step on an inner peripheral surface of the head cover 36, and a clip 67 is locked to a projection 66 of the head cover 36 extending through the upper partition plate 65*a* to retain the upper partition plate 65*a*.

The lower partition plate 65*b* is also utilized to close an opened upper surface of the gas-liquid separating chamber 73. Projectingly provided on a lower surface of the lower partition plate 65*b* are an angular U-shaped positioning wall 93 matched to an inner side face of the gas-liquid separating chamber 73 on the side of the partition wall 85, a straight positioning wall 94 matched to an inner side face of the gas-liquid separating chamber 73 on the side of the smaller partition wall 92, a small piece 95 disposed with the smaller partition wall 92 interposed between the small piece 95 and the straight positioning wall 94 to define an effective opening area of the outlet 92*a*, i.e., an opening degree between the gas-separating chamber 73 and the second valve-operating chamber 21*b*, and a labyrinth wall 96 protruding into the gas-separating chamber 73 to promote the gas-liquid separation.

The breather chamber 69 communicates with the second valve-operating chamber 21*b* through the communication bore 68 provided in the upper partition plate 65*a*, and on the other hand communicates with the inside of the air cleaner 4 through a breather pipe 70. The breather chamber 69 is an area where the oil and a blow-by gas mixed with each other are subjected to the gas-liquid separation, and a labyrinth wall 72 for promoting the gas-liquid separation is projectingly provided on the inner surface of the ceiling wall of the head cover 36. A visor 68*a* is formed on the upper partition plate 65*a* to cover the communication bore 68 from above for suppressing the entering of the oil drops from the second valve-operating chamber 21*b* into the breather chamber 69 to the utmost.

A plurality of (two in the illustrated embodiment) draw-up pipes 75 are formed integrally and projectingly on the lower partition plate 65*b* to communicate with the oil recovery chamber 74 at points spaced part from one another. The draw-up pipes 75 have tip ends extending to the vicinity of a bottom surface of the second valve-operating chamber 21*b*, and openings in the tip ends constitute orifices 75*a*.

A plurality of (three in the illustrated embodiment) draw-up pipes 76 are also formed integrally and projectingly on the upper partition plate 65*a* to communicate with the oil recovery chamber 74 at points spaced part from one another. The draw-up pipes 76 have tip ends extending to the vicinity of a ceiling surface of the breather 69, and openings in the tip ends constitute orifices 76*a*.

Further, pluralities of orifices 80 and 83 are provided in the lower partition plate 65*b* and the upper partition plate 65*a*, and permit the second valve-operating chamber 21*b* and the breather chamber 69 to communicate with the oil recovery chamber 74, respectively. A plurality of notch-shaped orifices 97 (FIG. 11) are provided in the mating surfaces of the partition plates 65*a* and 65*b* to permit the second valve-operating chamber 21*b* to communicate with the oil recovery chamber 74.

A single return pipe 81 is provided integrally and projectingly on the lower partition plate 65*b*, and opens into the oil recovery chamber 74. A tip end of the return pipe 81 is passed through the gas-liquid separating chamber 73 and fitted into an inlet 78*a* of the oil return passage 78 provided in the cylinder head 8 through a grommet 82, so that the oil recovered into the oil recovery chamber 74 is guided to the oil return passage 78.

An orifice 91 is further provided in the lower partition plate 65*b* to provide communication between the gas-liquid separating chamber 73 and the oil recovery chamber 74.

An orifice-shaped return bore 90 is provided in the return pipe 81 to communicate with a lower portion of the gas-liquid separating chamber 73, so that the oil accumulated in the gas-liquid separating chamber 73 is also discharged therefrom to the oil return passage 78.

The operation of the above-described lubricating system will be described below.

The breather chamber 69 communicates with the inside of the air cleaner 4 through the breather pipe 70 and hence, even during operation of the engine E, the pressure in the breather chamber 69 is maintained at the substantially atmospheric pressure. The second valve-operating chamber 21*b* communicating with the breather chamber 69 through the communication bore 68 with a small flow resistance, has a pressure substantially equal to that in the breather chamber 69. The pressure in the gas-liquid separating chamber 73 communicating with the second valve-operating chamber 21*b* through the outlet 92*a* with a small flow resistance is substantially equal to that in the second valve-operating chamber 21*b*.

During operation of the engine E, the crank chamber 6*a* discharges only a positive pressure component of a pressure pulsation generated by the ascending and descending of the piston 15 through the one-way valve 61 into the oil feed conduit 60. Therefore, the crank chamber 6*a* is averagely in a negative pressure state, and the second valve chamber 21*b* receives the positive pressure. The negative pressure in the crank chamber 6*a* is transmitted via the through-bore 55 in the crankshaft 13 to the oil tank 40, and further via the oil return passage 78 to the oil recovery chamber 74. As a result, the pressure in the oil recovery chamber 74 is lower than those in the second valve-operating chamber 21*b*, the gas-liquid separating chamber 73 and the breather chamber 69, and the pressures in the oil tank 40 and the first valve-operating chamber 21*a* are lower than that in the oil recovery chamber 74.

Figure 13:
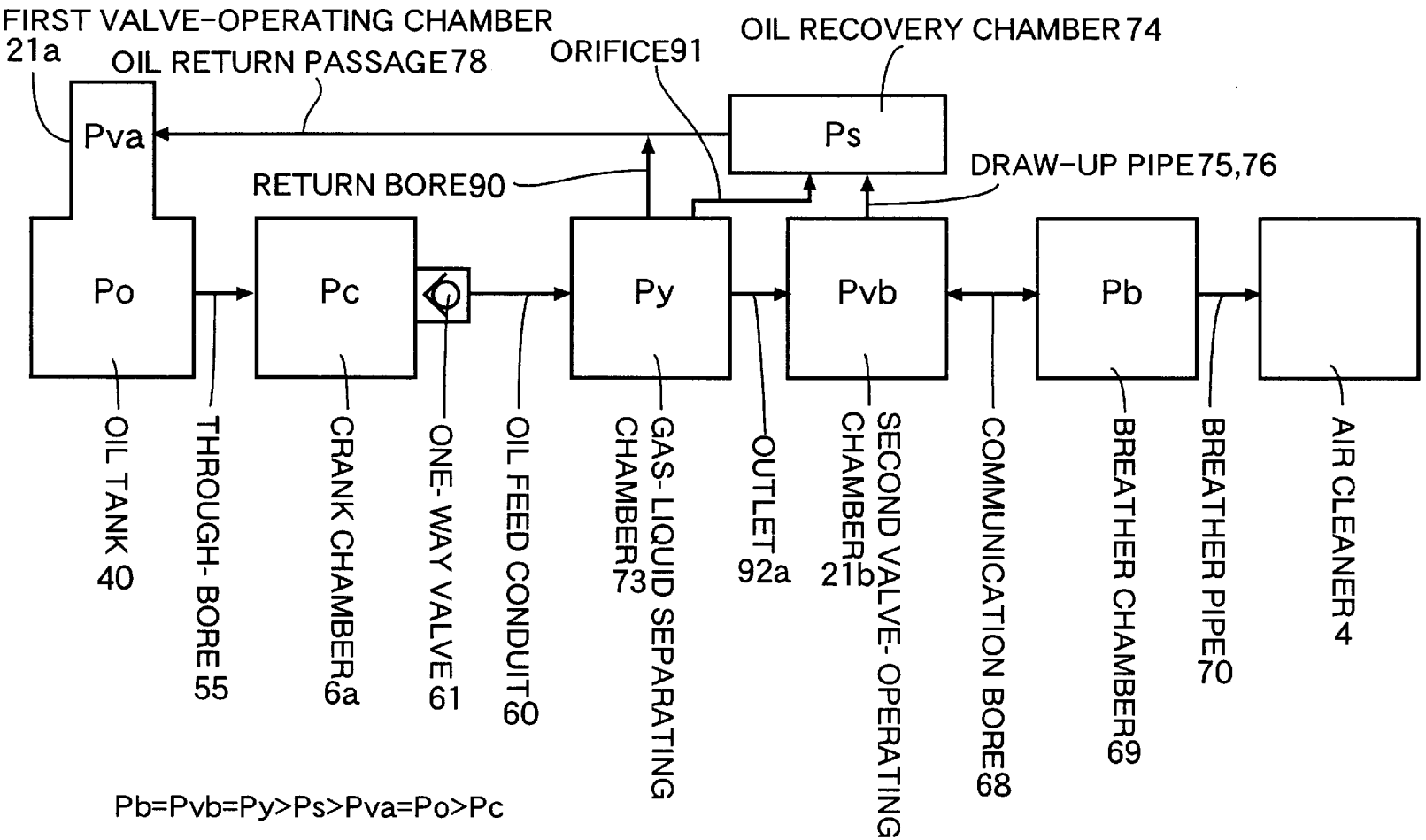

Therefore, as shown in FIG. 13, if the pressure in the crank chamber 6*a* is represented by Pc; the pressure in the oil tank 40 is represented by Po; the pressure in the first valve-operating chamber 21*a* is represented by Pva; the pressure in the second valve-operating chamber 21*b* is represented by Pvb; the pressure in the gas-liquid separating chamber 73 is represented by Py; the pressure in the oil recovery chamber 74 is represented by Ps; and the pressure in the breather chamber 69 is represented by Pb, the magnitude relationship among these pressures can be represented by the following equation:

$$Pb=Pvb=Py>Ps>Pva=Po>Pc$$

As a result, the pressures in the breather chamber 69 and the second valve-operating chamber 21*b* are transmitted through the draw-up pipes 75 and 76 and the orifices 80 and 83 to the oil recovery chamber 74; and the pressures in the gas-liquid separating chamber 73 is transmitted through the return bore 90 and the orifice 91 to the return pipe 81 and the oil recovery chamber 74. Then, these pressures are transmitted through the oil return passage 78 to the oil tank 40 and the crank chamber 6*a*.

During operation of the engine E, the oil slingers 56*a* and 56*b* rotated by the crankshaft 13 agitate and scatter the lubricating oil O to produce the oil mist in the oil tank 40. As described above, the oil splash generated at this time is sprinkled over a portion of the timing transmitting device 22*a* exposed from the belt guide tube 86 to the inside of the oil tank 40, i.e., portions of the driving pulley 23 and the timing belt 25, or enter the first valve-operating chamber 21*a* to directly lubricate the timing transmitting device 22*a*.

The oil mist produced in the oil tank 40 is drawn through the through-bore 55 in the crankshaft 13 into the crank chamber 6*a* along with the flow of the above-described pressures, to lubricate the surroundings of the crankshaft 13 and the piston 15. When the inside of the crank chamber 6*a* assumes a positive pressure by the descending of the piston 15, the oil mist flows upwards through the oil feed conduit 60 and the communication passage 63 upon opening of the one-way valve 61, to be supplied to the gas-liquid separating chamber 73. In this process, the oil drops in the oil mist are separated from the oil mist by the action of expansion of the oil mist and the action of collision of the oil mist against the labyrinth wall 96. The oil mist containing no oil drops is supplied to the second valve-operating chamber 21*b*, while being properly regulated in flow rate by the outlet 92*a*, thereby effectively lubricating various portions of the cam device 22*b* in the second valve-operating chamber 21*b*, i.e., the intake and exhaust rocker arms 33*i* and 33*e* and the like. Thus, it is possible to avoid the resistance to the operation of the cam device 22*b* due to the oil drops to provide a reduction in power loss.

The oil drops separated in the gas-liquid separating chamber 73 and accumulated in the bottom thereof is drawn out of the gas-liquid separating chamber 73 through the return bore 90 into the return pipe 81 and returned via the oil return passage 78 to the oil tank 40.

When the oil mist in the second valve-operating chamber 21*b* and the blow-by gas contained in the oil mist are passed through the communication bore 68 into the breather chamber 69, they are subjected to the gas-liquid separation by the action of expansion of the oil mist and the action of collision of the oil mist against the labyrinth wall 72. The blow-by gas is drawn sequentially via the breather pipe 70 and the air cleaner 4 into the engine E during an intake stroke of the engine E.

In an upright state of the engine E, the oil drops liquefied and accumulated in the breather chamber 69 are accumulated on an upper surface of the upper partition plate 65*a*, or flow down through the communication bore 68 to be accumulated on the bottom of the second valve-operating chamber 21*b* and hence, they are drawn up into the oil recovery chamber 74 by the orifices 80 and the draw-up pipes 75 positioned at these places. In an upside-down state of the engine E, the oil drops are accumulated on the ceiling surface of the head cover 36 and the lower surface of the lower partition plate 65*b* and hence, they are drawn up into the oil recovery chamber 74 by the draw-up pipes 76 and the orifices 83 and 97 positioned at these places. On the other hand, the oil drops separated from the oil mist are accumulated on the ceiling surface of the gas-liquid separating chamber 73, but are drawn up into the oil recovery chamber 74 by the orifice 91 opening into the ceiling surface.

The oil drawn up into the oil recovery chamber 74 in the above manner is returned from the return pipe 81 through the oil return passage 78 into the oil tank 40. In this case, if the oil return passage 78 is put into communication with the oil tank 40 through the second valve-operating chamber 21*b* as in the illustrated embodiment, the oil exiting the oil return passage 78 is sprinkled over the timing transmitting device 22*a*, to advantageously contribute to the lubrication of the timing transmitting device 22*a*.

The breather chamber 69 is defined between the ceiling surface of the head cover 36 and the upper partition plate 65*a* mounted to the inner wall of the head cover 36. The oil recovery chamber 74 is defined between the upper partition plate 65*a* and the lower partition plate 65*b* bonded to the upper partition plate 65*a*. Therefore, the oil recovery chamber 74 and the breather chamber 69 can be provided in the head cover 36 without dividing the ceiling wall of the head cover 36. Moreover, since both the breather chamber 69 and the oil recovery chamber 74 exist in the head cover 36, even if some leakage of the oil from the chambers 69 and 74 occurs, the oil is merely returned to the second valve-operating chamber 21*b* without any problem. Thus, the examination of the oil tightness around both the chambers 69 and 74 is not required, whereby the manufacture cost can be reduced.

Moreover, the oil recovery chamber 74 is formed simultaneously with the bonding of the upper partition plate 65*a* and the lower partition plate 65*b* to each other, and hence the formation of the oil recovery chamber 74 can be conducted easily.

Further, the oil draw-up pipes 75 and 76 are integrally formed on the upper partition plate 65*a* and the lower partition plate 65*b*, respectively, and hence the formation of the oil draw-up pipes 75 and 76 can be also conducted easily.

The gas-liquid separating chamber 73 is defined between the bearing bosses 30*i* and 30*e* supporting the pair of intake and exhaust rocker shafts 31*i* and 31*e* and hence, a relatively narrow space in the head cover 36 can be efficiently utilized for the formation of the gas-liquid separating chamber 73, and an increase in size of the head cover 36 can be avoided. Moreover, the opened upper surface of the gas-liquid separating chamber 73 is closed by the lower partition plate 65*b* and hence, a special member for closing the opened upper surface is not required, whereby the structure can be simplified.

Figure 14:
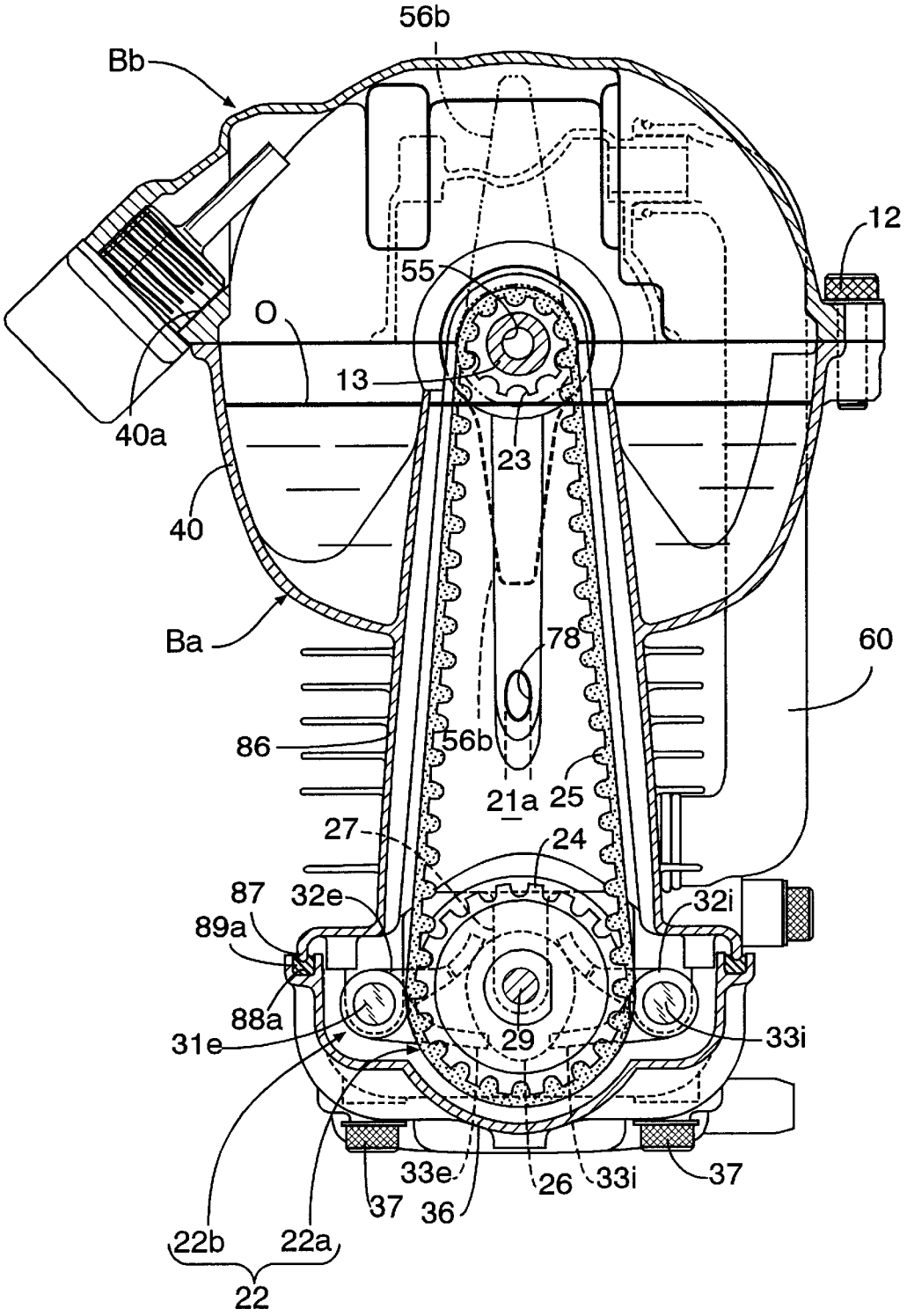

On the other hand, when the engine E is brought into the upside-down state, as shown in FIG. 14, the oil O stored in the oil tank 40 is moved toward the ceiling of the tank 40, i.e., toward the first valve-operating chamber 21*a*. However, the end of the first valve-operating chamber 21*a* opened into the oil tank 40 is set to assume a position higher than the liquid surface of the stored oil O by the belt guide tube 86 and hence, the flowing of the stored oil O into the second valve-operating chamber 21*b* is not permitted. Therefore, it is possible to prevent the excessive supplying of the oil to the timing transmitting device 22*a* and to maintain a predetermined amount of the oil in the oil tank 40 to continue the production of the oil mist by the oil slingers 56*a* and 56*b*.

Figure 15:
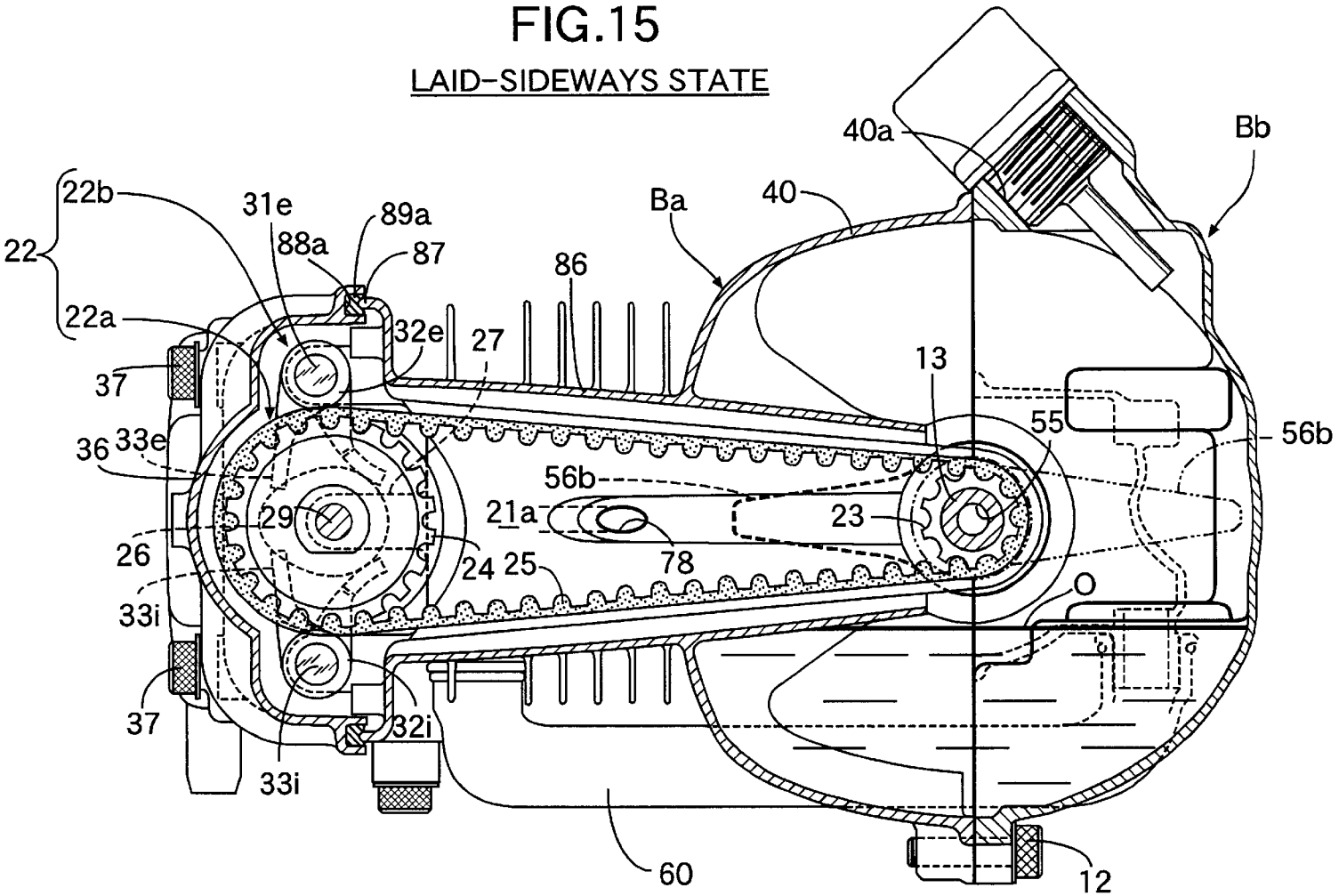
Figure 16:
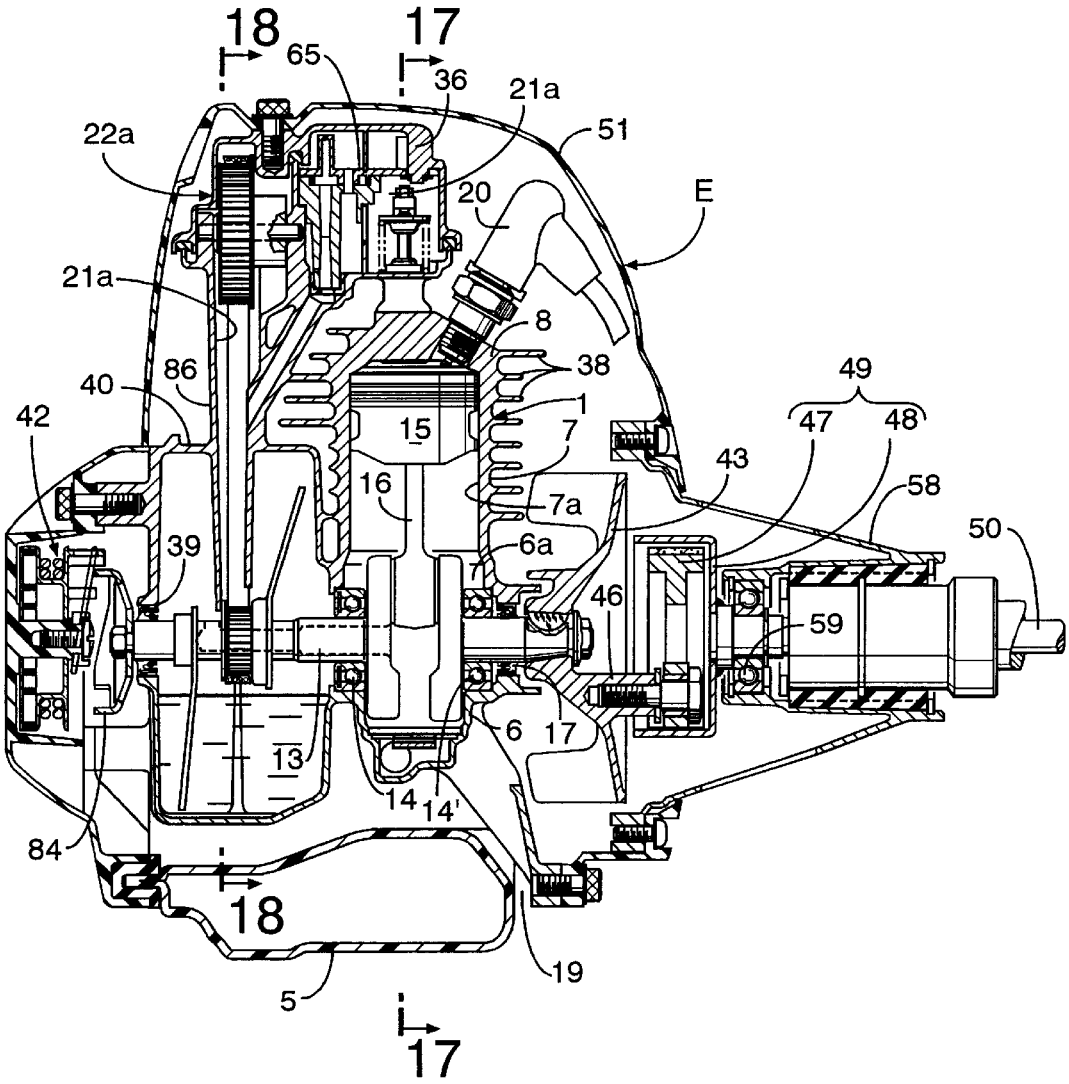
FIGS. 16 to 26 show a second embodiment of the present invention.
Figure 17:
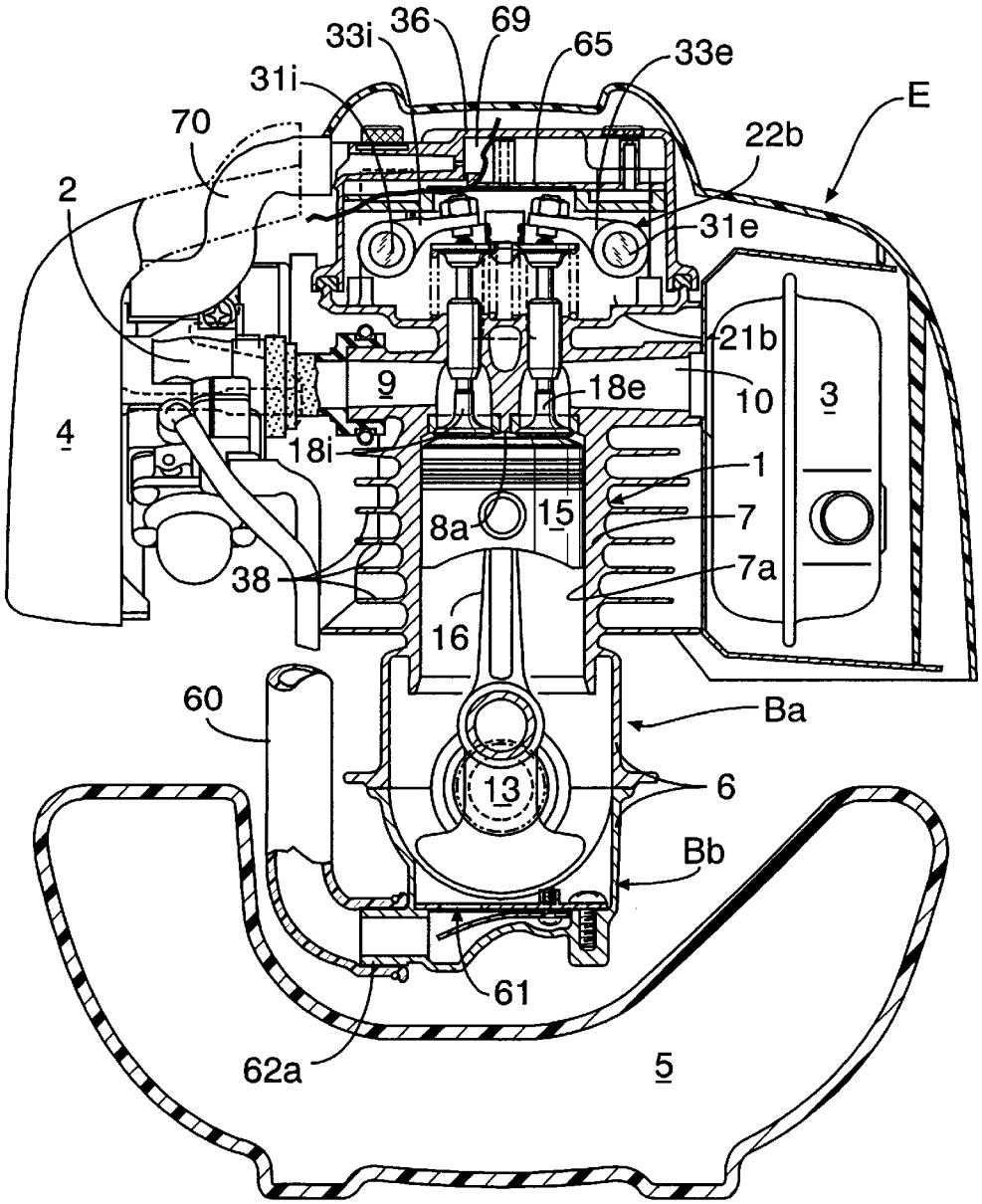

When the engine E is brought into a laid-sideways state, as shown in FIG. 15, the stored oil O is moved toward the side face of the oil tank 40. However, the end of the first valve-operating chamber 21*a* opened into the oil tank 40 is set to assume a position higher than the liquid surface of the stored oil O by the belt guide tube 86 and hence, also in this case, the flowing of the stored oil O into the second valve-operating chamber 21*b* is not permitted. Therefore, it is possible to prevent the excessive supplying of the oil to the timing transmitting device 22*a* and to maintain a predetermined amount of the oil in the oil tank 40 to continue the production of the oil mist by the oil slingers 56*a* and 56*b*.

Thus, the system for lubricating the valve-operating mechanism 22 is divided into the two lines: the line for lubricating portions of the timing transmitting device 22*a* and the cam device 22*b* within the oil tank 40 and the first valve-operating chamber 21*a* by the scattered oil within the oil tank 40; and the line for lubricating the remaining portions of the cam device 22*b* within the second valve-operating chamber 21*b* by the oil mist transferred into the second valve-operating chamber 21*b*. Therefore, the burden on each of the lines of the lubricating system is alleviated, and the entire valve-operating mechanism 22 can be thoroughly lubricated. Moreover, the various portions of the engine can be lubricated by use of the oil splash and the oil mist even in any operative position of the engine.

The oil mist generated in the oil tank 40 is circulated by utilizing the pressure pulsation in the crank chamber 6*a* and the unidirectional transferring function of the one-way valve 61. Therefore, an oil pump exclusive for circulating the oil mist is not required, whereby the structure can be simplified.

Not only the oil tank 40 but also the oil feed conduit 60 connecting the crank chamber 6*a* and the second valve-operating chamber 21*b* to each other, are disposed outside the engine body 1, and hence the reduction in wall thickness of and the compactness of the engine body 1 are not hindered in any way, which can greatly contribute to a reduction in weight of the engine E. Especially, the oil feed conduit 60 disposed outside the engine body 1 is difficult to be thermally affected from the engine body 1, and is prone to dissipate heat. Therefore, it is possible to promote the cooling of the oil mist flowing through the oil feed conduit 60.

In addition, since the oil tank 40 is disposed outside the engine body 1, a remarkable reduction in entire height of the engine E can be brought about. Moreover, a portion of the timing transmitting device 22*a* is accommodated in the oil tank 40 and hence, the increase in the width of the engine E can be minimized, leading to the compactness of the engine E.

A second embodiment of the present invention will now be described with reference to FIGS. 16 to 26.

The second embodiment is different from the first embodiment in respect of both a system for lubricating the engine E and a breather system. The arrangement of the other parts is basically the same as in the first embodiment and hence, portions or components corresponding to those in the first embodiment are denoted by the same reference numerals in FIGS. 16 to 26, and the descriptions thereof are omitted.

The system for lubricating the engine E and the breather system according to the second embodiment will be described below.

Figure 18:
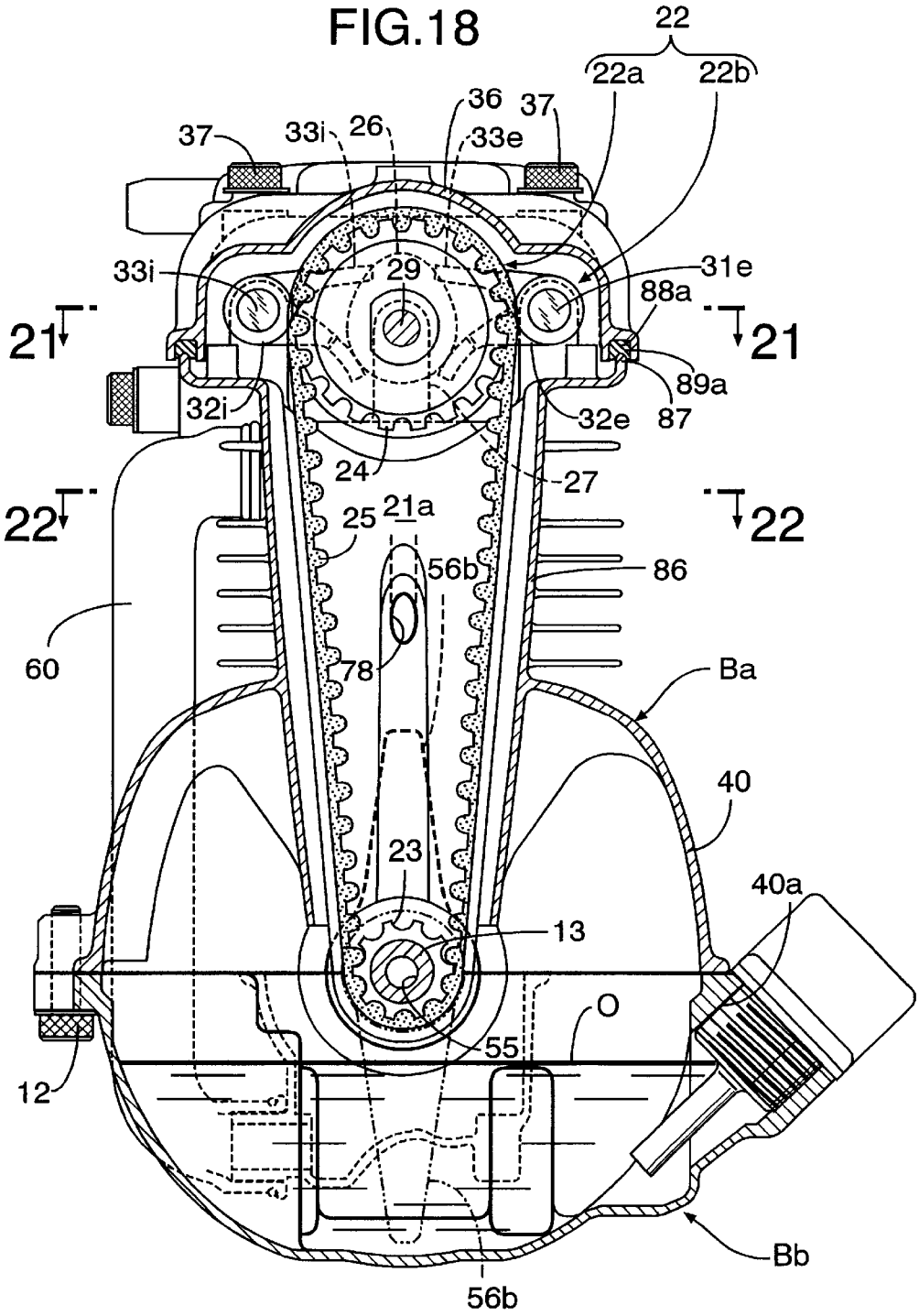
Figure 19:
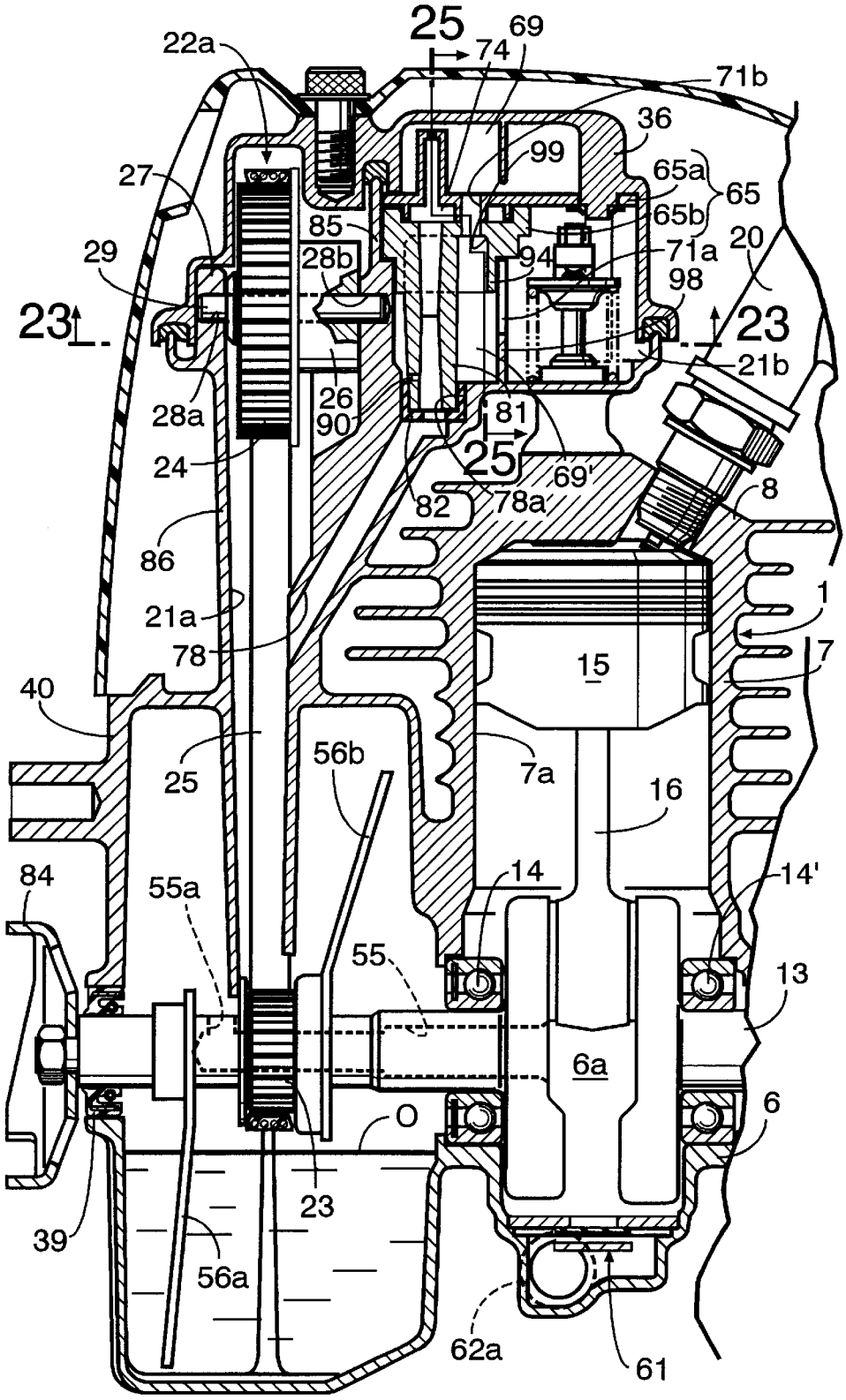
Figure 20:
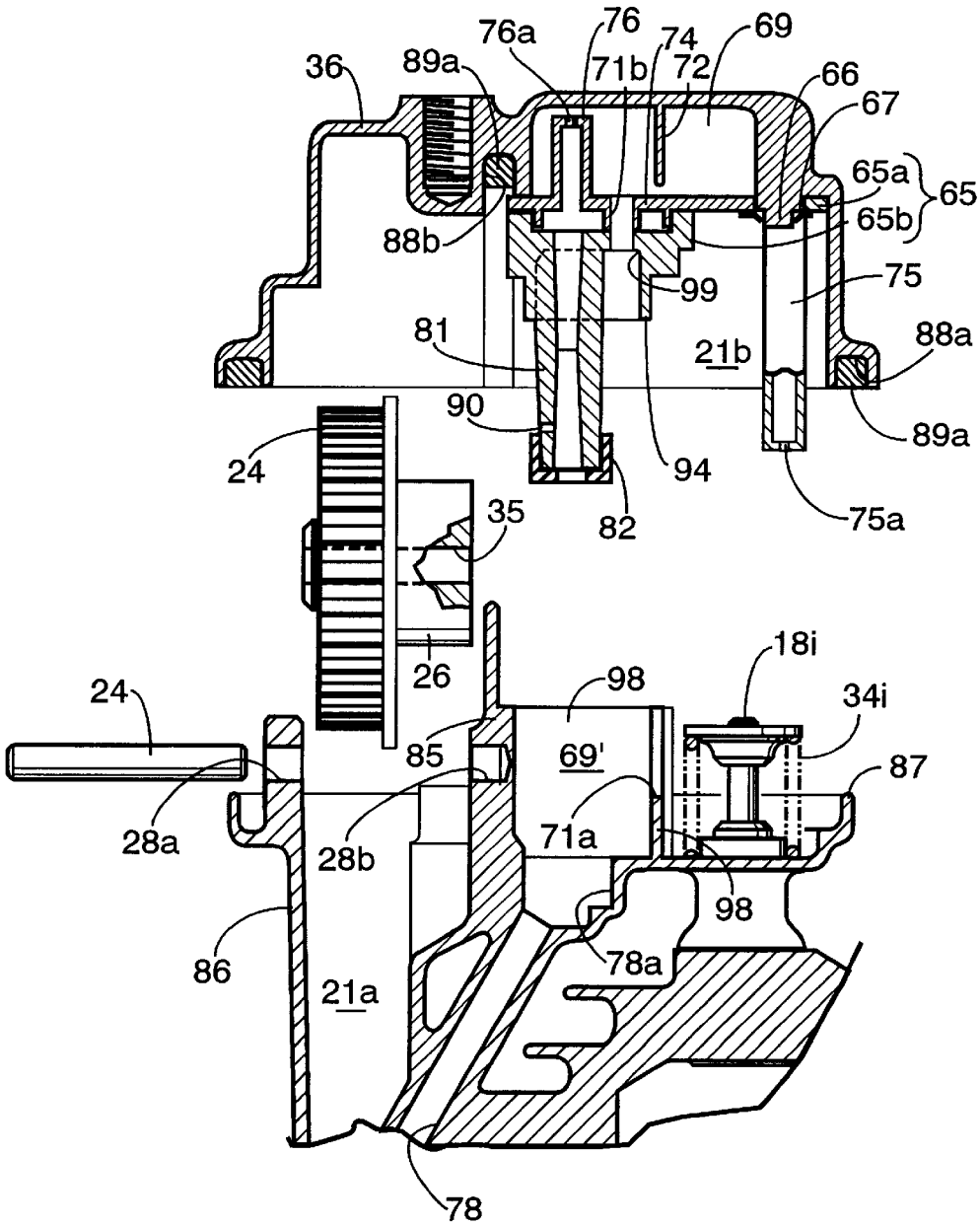
Figure 21:
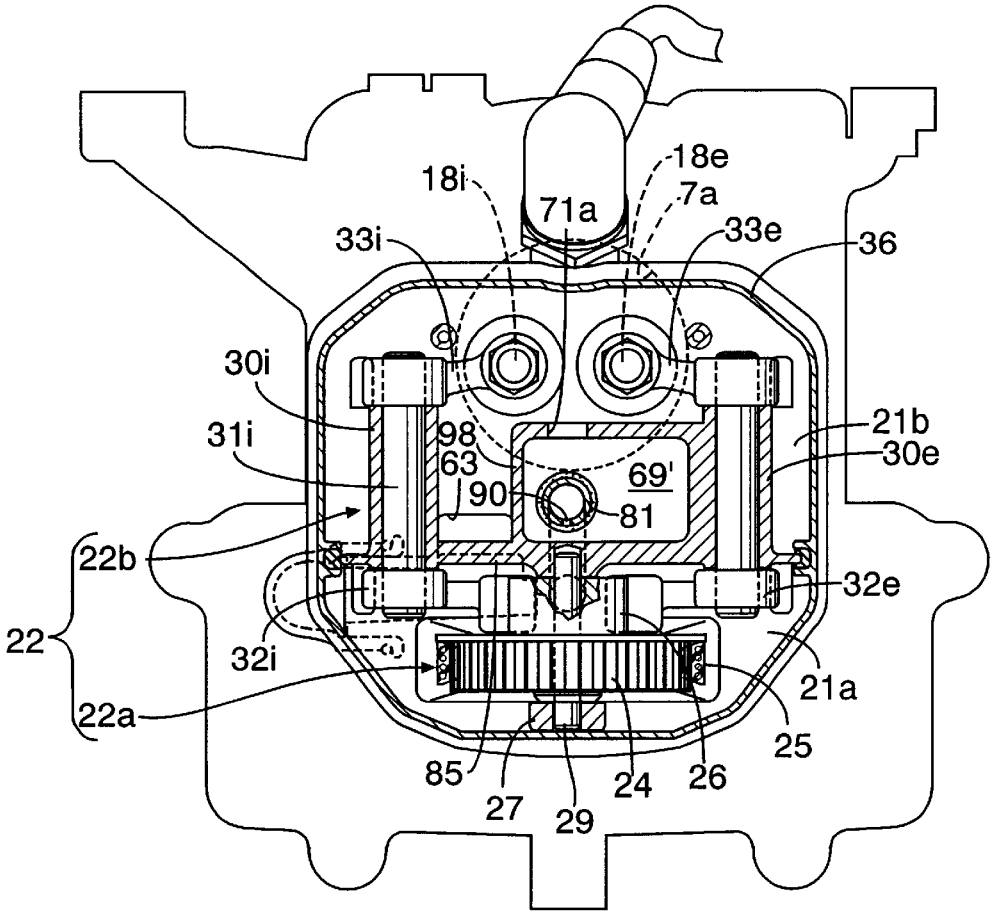
Figure 22:
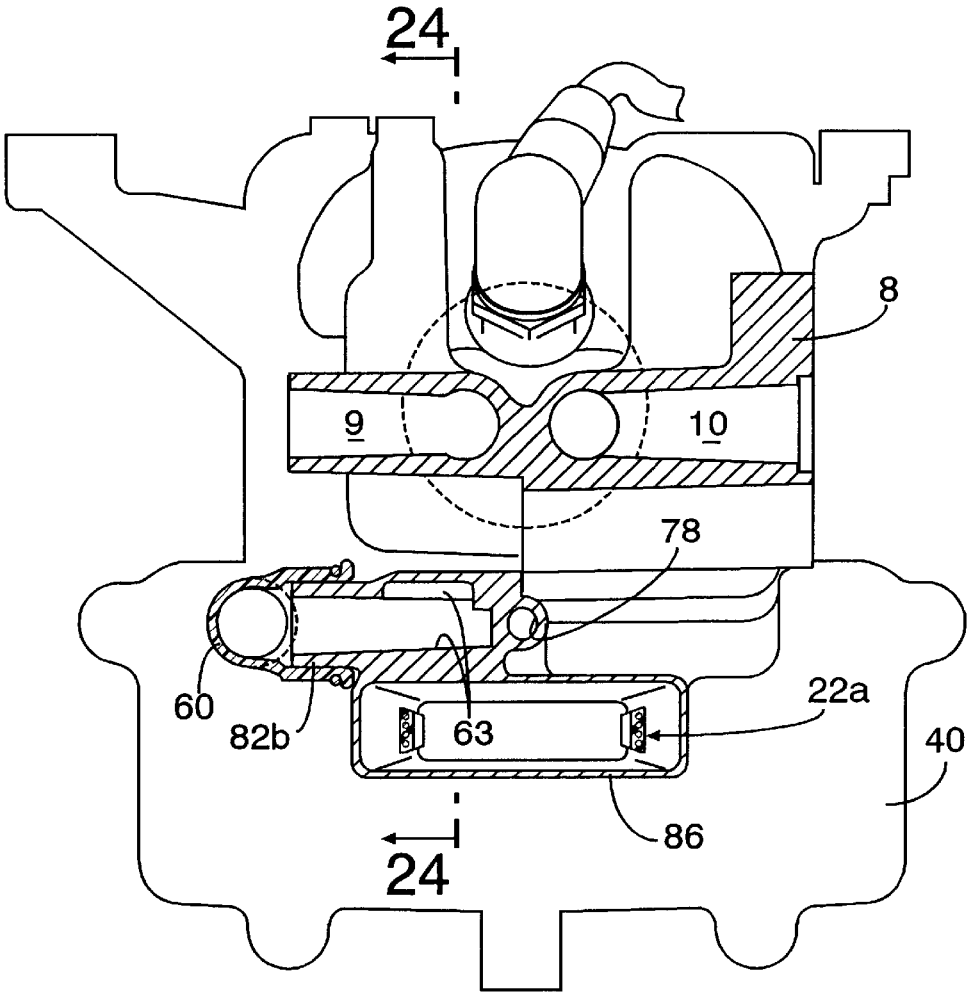
Figure 23:
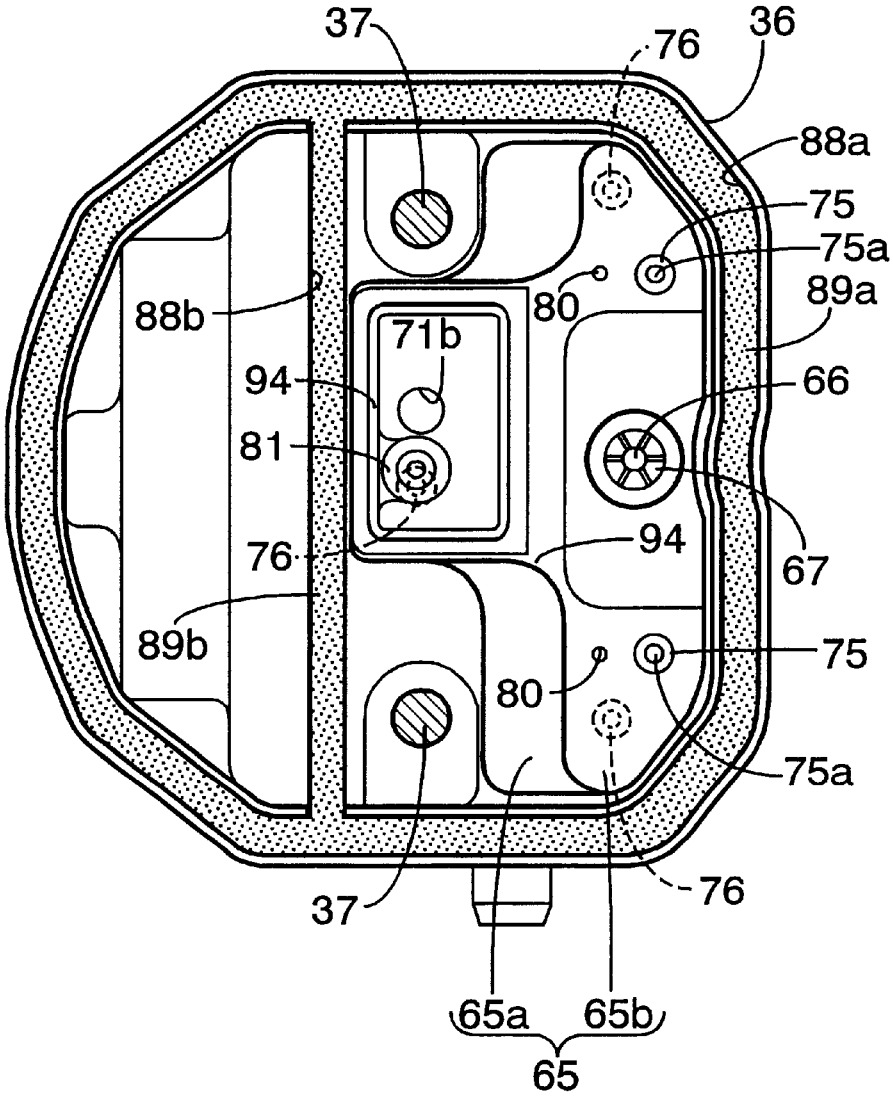
Figure 24:
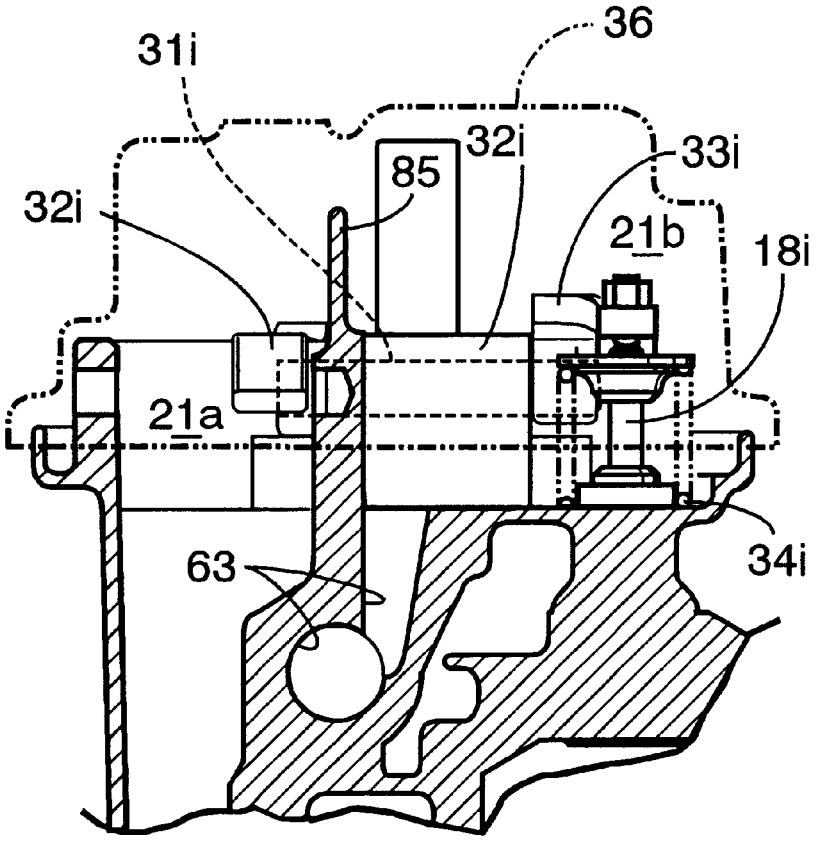
Figure 25:
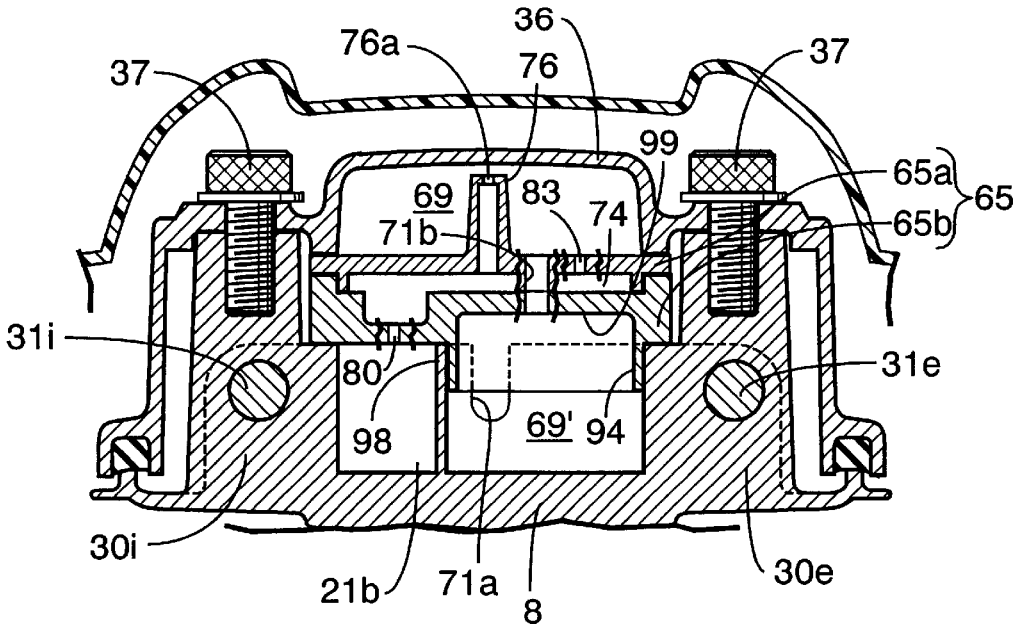

Referring to FIGS. 18 and 19, a specified amount of a lubricating oil O introduced through an oil supply port 40*a* is stored in an oil tank 40. A pair of oil slingers 56*a* and 56*b* are secured by press-fitting to the crankshaft 13 in the oil tank 40 and arranged coaxially with each other on opposite sides of the driving pulley 23. The oil slingers 56*a* and 56*b* extend to radially opposite directions and are bent so that their tip ends axially going away from each other. When the oil slingers 56*a* and 56*b* are rotated by the crankshaft 13, at least one of the oil slingers 56*a* and 56*b* agitates and scatters the oil O stored in the oil tank 40 even in any operative position of the engine E to produce an oil mist. At this time, the produced oil splash is scattered over a portion of the timing transmitting device 22*a* exposed from the first valve-operating chamber 21*a* to the inside of the oil tank 40, or caused to enter the first valve-operating chamber 21*a*, to thereby directly lubricate the timing transmitting device 22*a*. This is one line of the lubricating system.

As shown in FIGS. 17 and 19 to 26, the other line of the lubricating system includes a through-bore 55 provided in the crankshaft 13 to provide communication between the inside of the oil tank 40 and the crank chamber 6*a*, an oil feed conduit 60 for guiding the oil mist from the crank chamber 6*a* to the second valve-operating chamber 21*b*, an oil recovery chamber 74 provided in the cylinder head 8 to draw up the oil drops accumulated in the second valve-operating chamber 21*b*, an oil return passage 78 defined between the cylinder head 8 and the oil tank 40 to permit the oil recovery chamber 74 to communicate with the oil tank 40 through the first valve-operating chamber 21*a*, and a one-way valve 61 placed at a lower portion of the crank chamber 6*a* to only permit the flow of the oil mist only in one direction from the crank chamber 6*a* to the oil feed conduit 60.

An end 55*a* of the through-bore 55 opened into the oil tank 40 is disposed at or in the vicinity of the center portion of the inside of the oil tank 40 so that it is always exposed above the surface of the oil O in the oil tank 40 even in any position of the engine E. The driving pulley 23 secured to the crankshaft 13 and one of the oil slingers 56*a* are disposed with the opened end 55*a* located therebetween so that they do not occlude the opened end 55*a*.

The one-way valve 61 (see FIG. 17) is a reed valve in the illustrated embodiment, and is operated with the reciprocal movement of the piston 15 so that it is closed when the inside of the crank chamber 6*a* is subjected to a negative pressure, and it is opened when the inside of the crank chamber 6*a* is subjected to a positive pressure.

The oil feed conduit 60 has a lower end fitted over and connected to a lower connecting pipe 62*a* (see FIG. 17) projectingly provided on the outer surface of the crankcase 6, and an upper end fitted over and connected to an upper connecting pipe 62*b* (see FIGS. 18 and 22) projectingly provided on the outer surface of the cylinder head 8. The inside of the upper connecting pipe 62*b* communicates with the second valve-operating chamber 21*b* through a communication passage 63 (see FIGS. 22 and 23) in the cylinder head 8.

As shown in FIGS. 19, 20 and 23 to 25, a partitioning member 65 is disposed on the head cover 36. The partitioning member 65 is comprised of an upper partition plate 65*a* made of a synthetic resin and defining a breather chamber 69 between the partition plate 65*a* and a ceiling surface of the head cover 36, and a lower partition plate 65*b* made of a synthetic resin and bonded to a lower surface of the upper partition plate 65*a* by welding or adhesion to define the flat oil recovery chamber 74 between the lower partition plate 65*b* and the upper partition plate 65*a*. To mount the partitioning member 65 to the head cover 36, a peripheral edge of the upper partition plate 65*a* is put into abutment against a step on an inner peripheral surface of the head cover 36, and a clip 67 is locked to a projection 66 of the head cover 36 extending through the upper partition plate 65*a* to retain the upper partition plate 65*a*. A labyrinth wall 72 is projectingly provided on an inner surface of the ceiling surface of the head cover 36 in order to promote the gas-liquid separation in the breather chamber 69.

A gas-liquid separating chamber 69' is provided between the lower partition plate 65*b* and the upper surface of the cylinder head 8. More specifically, a bottom wall and a ceiling wall of the gas-liquid separating chamber 69' are formed by the cylinder head 8 and the lower partition plate 65*b*, respectively. Four sidewalls of the gas-liquid separating chamber 69' are formed by the bearing bosses 30*i* or 30*e*, the partition wall 85, and an L-shaped partition wall 98 rising from the upper surface of the cylinder head 8 and connected to the bearing boss 30*i* or 30*e* and the partition wall 85. In this case, a recess 99 is formed at a portion of the lower surface of the lower partition plate 65*b* which faces the gas-liquid separating chamber 69', in order to maximize the volume of the gas-liquid separating chamber 69'. A positioning wall 94 is formed at a peripheral edge of an opening in the recess 99 and fitted to an inner peripheral surface of the gas-liquid separating chamber 69'. In this way, the gas-liquid separating chamber 69' is disposed between a pair of rocker shafts 31*i* and 32*e* which are components of the valve-operating mechanism 22 in the second valve-operating chamber 21*b* immediately below the breather chamber 69.

The gas-liquid separating chamber 69' communicates with the second valve-operating chamber 21*b* through a notch-shaped first communication bore 71*a* provided in the partition wall 98 and also communicates with the breather chamber 69 through a second communication bore 71*b* passing through the upper and lower partition plates 65*a* and 65*b*. On the other hand, the breather chamber 69 communicates with the inside of the air cleaner 4 through a breather pipe 70.

A plurality (two in the illustrated embodiment) of draw-up pipes 75 are provided integrally and projectingly on the lower partition plate 65*b* to communicate with the oil recovery chamber 74 at points spaced part from one another. The draw-up pipes 75 have tip ends extending to the vicinity of a bottom surface of the second valve-operating chamber 21*b*, and openings in the tip ends constitute orifices 75*a*.

A plurality (three in the illustrated embodiment) of draw-up pipes 76 are also provided integrally and projectingly on the upper partition plate 65*a* to communicate with the oil recovery chamber 74 at points spaced part from one another. The draw-up pipes 76 have tip ends extending to the vicinity of a ceiling surface of the breather 69, and openings in the tip ends constitute orifices 76*a*.

Further, pluralities of orifices 80 and 83 are provided in the lower partition plate 65*b* and the upper partition plate 65*a*, and permit the second valve-operating chamber 21*b* and the breather chamber 69 to communicate with the oil recovery chamber 74, respectively. A plurality of notch-shaped orifices 97 (FIG. 25) are provided in the bonded surfaces of the partition plates 65*a* and 65*b* to permit the second valve-operating chamber 21*b* to communicate with the oil recovery chamber 74.

A single return pipe 81 is provided integrally and projectingly on the lower partition plate 65*b*, and opens into the oil recovery chamber 74. A tip end of the return pipe 81 is passed through the gas-liquid separating chamber 69' and fitted into an inlet 78*a* of the oil return passage 78 provided in the cylinder head 8 through a grommet 82, so that the oil recovered into the oil recovery chamber 74 is guided to the oil return passage 78.

An orifice-like return bore 90 is provided in the return pipe 81 to communicate with the lower portion of the gas-liquid separating chamber 69', so that the oil accumulated in the gas-liquid separating chamber 69' is also discharged out of the gas-liquid separating chamber 69' into the oil return passage 78.

The operation of the second embodiment will be described below.

The breather chamber 69 communicates with the inside of the air cleaner 4 through the breather pipe 70 and hence, even during operation of the engine E, the pressure in the breather chamber 69 is maintained at the substantially atmospheric pressure. The pressures in the gas-liquid separating chamber 69' communicating with the breather chamber 69 through the second communication bore 71*b* and the second valve-operating chamber 21*b* communicating with the gas-liquid separating chamber 69' through the second communication bore 71, are also substantially equal to that in the breather chamber 69.

During operation of the engine E, the crank chamber 6*a* discharges only a positive pressure component of a pressure pulsation generated by the ascending and descending of the piston 15 through the one-way valve 61 into the oil feed conduit 60. Therefore, the crank chamber 6*a* is averagely in a negative pressure state, and the second valve chamber 21*b* receives the positive pressure. The negative pressure in the crank chamber 6*a* is transmitted via the through-bore 55 in the crankshaft 13 to the oil tank 40, and further through the oil return passage 78 to the oil recovery chamber 74. As a result, the pressure in the oil recovery chamber 74 is lower than those in the second valve-operating chamber 21*b*, the gas-liquid separating chamber 69' and the breather chamber 69, and the pressures in the oil tank 40 and the first valve-operating chamber 21*a* are lower than that in the oil recovery chamber 74.

Figure 26:
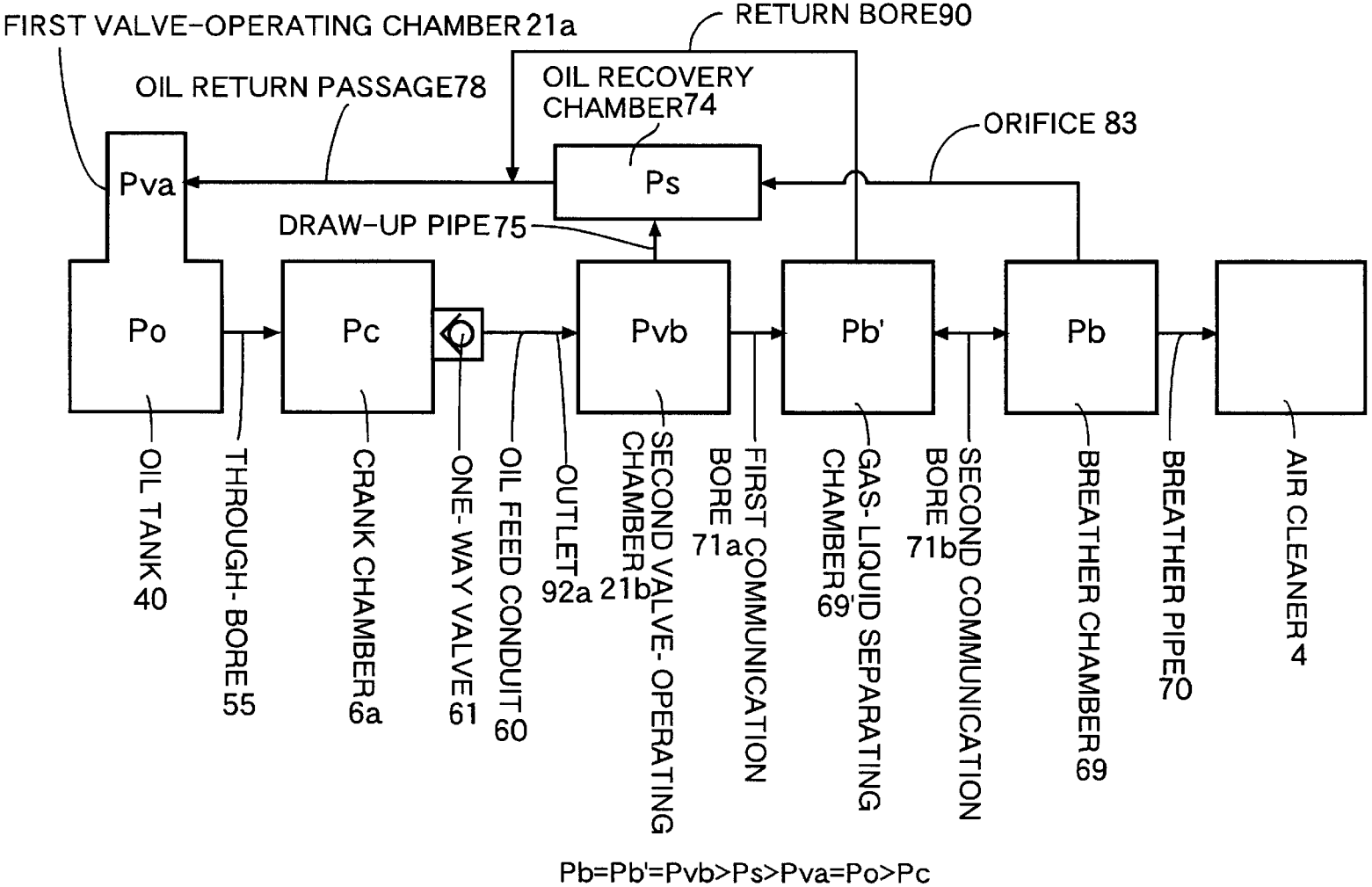

Therefore, as shown in FIG. 26, if the pressure in the crank chamber 6*a* is represented by Pc; the pressure in the oil tank 40 is represented by Po; the pressure in the first valve-operating chamber 21*a* is represented by Pva; the pressure in the second valve-operating chamber 21*b* is represented by Pvb; the pressure in the oil recovery chamber 74 is represented by Ps; and the pressure in the gas-liquid separating chamber 69' is represented by $Pb_1$; and the pressure in the breather chamber 69 is represented by $Pb_2$, the magnitude relationship among these pressures can be represented by the following equation:

$$Pb_2=Pb_1=Pvb>Ps>Pva=Po>Pc$$

As a result, the pressures in the breather chamber 69 and the second valve-operating chamber 21*b* are transmitted through the draw-up pipes 75 and 76 and the orifices 80 and 83 to the oil recovery chamber 74; and the pressures in the gas-liquid separating chamber 69' is transmitted through the return bore 90 to the return pipe 81. Then, these pressures are transmitted through the oil return passage 78 to the oil tank 40 and the crank chamber 6*a*.

During operation of the engine E, the oil slingers 56*a* and 56*b* rotated by the crankshaft 13 agitate and scatter the lubricating oil O to produce the oil mist in the oil tank 40. The oil splash generated at this time is sprinkled over a portion of the timing transmitting device 22*a* exposed from the belt guide tube 86 to the inside of the oil tank 40, i.e., portions of the driving pulley 23 and the timing belt 25, or enter the first valve-operating chamber 21*a* to directly lubricate the timing transmitting device 22*a*.

The oil mist produced in the oil tank 40 is drawn through the through-bore 55 in the crankshaft 13 into the crank chamber 6*a* along with the flow of the above-described pressures, to lubricate the surroundings of the crankshaft 13 and the piston 15. When the inside of the crank chamber 6*a* assumes a positive pressure by the descending of the piston 15, the oil mist flows upwards through the oil feed conduit 60 upon opening of the one-way valve 61, to be supplied through the communication passage to the second valve-operating chamber 21*b*, to thereby effectively lubricate various portions of the cam device 22*b* within the second valve-operating chamber 21*b*, i.e., the intake and exhaust rocker arms 33*i* and 33*e* and the like.

The blow-by gas produced in the crank chamber 6*a* is passed through the same path as in the case of the oil mist, to reach the second valve-operating chamber 21*b*. Therefore, a large amount of the oil mist is contained in the blow-by gas. The blow-by gas having reached the second valve-operating chamber 21*b* is first transferred through the first communication bore 71*a* into the gas-liquid separating chamber 69', and then transferred through the second communication bore 71*b* into the breather chamber 69. Thus, the oil is effectively separated from the blow-by gas by the gas-liquid separation caused by the two stages of expansion in the gas-liquid separating chamber 69' and the breather chamber 69. Therefore, the blow-by gas containing substantially no oil is discharged from the breather chamber 69 into the breather pipe 70 and hence, the unnecessary consumption of the oil can be suppressed. The blow-by gas is then passed through the air cleaner 4 and drawn into the engine E, where the blow-by gas is burned without contaminating an exhaust gas from the engine.

When the engine is operated in an upright state, the oil liquefied and accumulated in the breather chamber 69 is accumulated on the upper surface of the upper partition plate 65*a*, or permitted to flow downwards through the second communication bore 71*b*, and transferred into the gas-liquid separating chamber 69'. The oil accumulated on the bottom of the gas-liquid separating chamber 69' is returned through the return bore 90, the return pipe 81 and the oil return passage 78 to the oil tank 40. The oil accumulated on the bottom of the breather chamber 69 is drawn up into the oil recovery chamber 74 by the orifices 83. On the other hand, the oil which has finished the lubrication of the valve-operating mechanism 22 and has been accumulated on the bottom of the second valve-operating chamber 21*b* is also drawn up into the oil recovery chamber 74 by the drawn-up pipes 75. These oils are returned through the return pipe 81 and the oil return passage 78 into the oil tank 40.

When the engine E is operated in an upside-down state, the oil is accumulated on the ceilings of the breather chamber 69 and the second valve-operating chamber 21*b*, and hence the oil is drawn up into the oil recovery chamber 74 by the draw-up pipes 76 and the orifices 83 and 97 positioned at such places, and subsequently returned through the return pipe 81 and oil return passage 78 into the oil tank 40 as in the case where the engine E is in an upright state.

The gas-liquid separating chamber 69' is disposed between the pair of rocker shafts 31*i* and 31*e* which are the components of the valve-operating mechanism 22, in the second valve-operating chamber 21*b* immediately below the breather chamber 69, and hence a dead space between the rocker shafts 31*i* and 31*e* is utilized for disposition of the gas-liquid separating chamber 69', so that the gas-liquid separating effect for the blow-by gas can be enhanced by cooperation of the gas-liquid separating chamber 69' and the breather chamber 69. Therefore, the volume of the breather chamber 69 within the head cover 36 need not be increased, whereby an increase in size of the head cover 36 can be avoided.

Although the embodiments of the present invention have been described in detail, it will be understood that the present invention is not limited to the above-described embodiments, and various modifications in design may be made without departing from the spirit and scope of the invention defined in claims. For example, the number and the installation places of the oil draw-up pipes 75 and 76 and the draw-up orifices 80 and 83 may be selected as desired. A rotary valve operated in association with the crankshaft 13 to open the oil feed conduit 60 upon the descending of the piston 15 and close the oil feed conduit 60 upon the ascending of the piston 15, may be provided in place of the one-way valve 61.

What is claimed is:

1. A system for lubricating a valve-operating mechanism in an engine comprising a head cover coupled to an upper end of a cylinder head, a valve-operating chamber defined between said cylinder head and said head cover for accommodation of a valve-operating mechanism, an oil mist transfer means for transferring an oil mist produced in an oil tank, an oil recovery chamber for recovering the oil accumulated in said valve-operating chamber by suction, a breather chamber into which a blow-by gas is introduced from said valve-operating chamber and from which the blow-by gas is discharged to the outside, said oil mist transfer means, said oil recovery chamber and said breather chamber leading to said valve-operating chamber, and an oil return passage connected to said oil recovery chamber for returning the oil recovered in said oil recovery chamber to said oil tank, wherein a gas-liquid separating chamber is disposed in said valve-operating chamber below said breather chamber and incorporated in a path extending from said oil mist transfer means via said valve-operating chamber to said breather chamber for separating oil drops from the oil mist or the blow-by gas.

2. A system for lubricating a valve-operating mechanism in an engine according to claim 1, wherein a partitioning member is mounted to an inner wall of said head cover to define said breather chamber between said partitioning member and a ceiling surface of said head cover; said oil recovery chamber is formed integrally with said partitioning member; and said gas-liquid separating chamber is defined between said partitioning member and said cylinder head.

3. A system for lubricating a valve-operating mechanism in an engine according to claim 1 or 2, wherein said gas-liquid separating chamber is provided between said oil mist transfer means and said valve-operating chamber for separating oil drops from the oil mist fed from said oil mist transfer means to guide the oil mist containing no oil drops to said valve-operating chamber.

4. A system for lubricating a valve-operating mechanism in an engine according to claim 3, wherein said gas-liquid separating chamber is disposed between a pair of intake and exhaust rocker shafts of said valve-operating mechanism which are arranged in parallel to each other.

5. A system for lubricating a valve-operating mechanism in an engine according to claim 3, wherein said gas-liquid separating chamber communicates with an oil return passage to return the oil drops separated in said gas-liquid separating chamber to said oil tank.

6. A system for lubricating a valve-operating mechanism in an engine according to claim 1 or 2, wherein said gas-liquid separating chamber communicates with said valve-operating chamber and said breather chamber through first and second communication bores, respectively.

7. A system for lubricating a valve-operating mechanism in an engine according to claim 6, wherein said gas-liquid separating chamber is disposed between components of said valve-operating mechanism.

* * * * *

UNITED STATES PATENT AND TRADEMARK OFFICE

CERTIFICATE OF CORRECTION

PATENT NO. : 6,715,461 B2
DATED : August 6, 2004
INVENTOR(S) : Keita Ito et al.

It is certified that error appears in the above-identified patent and that said Letters Patent is hereby corrected as shown below:

Title page,
Item [30], Foreign Application Priority Data, change "Nov. 19, 2001 (JP) ...2001-284677" to be -- Sep. 19, 2001 (JP) ...2001-284677 --.

Signed and Sealed this

Tenth Day of August, 2004

JON W. DUDAS
*Acting Director of the United States Patent and Trademark Office*